US009976369B2

(12) United States Patent
Rothenwaender et al.

(10) Patent No.: US 9,976,369 B2
(45) Date of Patent: May 22, 2018

(54) DEVICE AND METHOD FOR EXTRACTING A SAMPLE WHILE MAINTAINING A PRESSURE THAT IS PRESENT AT THE SAMPLE EXTRACTION LOCATION

(71) Applicant: CORSYDE INTERNATIONAL GMBH & CO. KG, Schoenefeld (DE)

(72) Inventors: Tobias Rothenwaender, Berlin (DE); David Wunsch, Berlin (DE); Erik Anders, Berlin (DE); Martin Rothfuss, Berlin (DE); Benjamin Arnold, Leipzig (DE); Alexander Schulze, Berlin (DE)

(73) Assignee: CORSYDE INTERNATIONAL GMBH & CO. KG, Schoenefeld (DE)

( * ) Notice: Subject to any disclaimer, the term of this patent is extended or adjusted under 35 U.S.C. 154(b) by 972 days.

(21) Appl. No.: 14/354,457

(22) PCT Filed: Oct. 24, 2012

(86) PCT No.: PCT/EP2012/071046
§ 371 (c)(1),
(2) Date: Apr. 25, 2014

(87) PCT Pub. No.: WO2013/060720
PCT Pub. Date: May 2, 2013

(65) Prior Publication Data

US 2014/0262527 A1 Sep. 18, 2014

(30) Foreign Application Priority Data

Oct. 25, 2011 (DE) ..... 10 2011 085 192

(51) Int. Cl.
*E21B 25/08* (2006.01)

(52) U.S. Cl.
CPC ..... *E21B 25/08* (2013.01)

(58) Field of Classification Search
CPC ..... E21B 25/00; E21B 25/04; E21B 25/06; E21B 25/08; E21B 25/10
See application file for complete search history.

(56) References Cited

U.S. PATENT DOCUMENTS 3,207,223 A 9/1965 Hugel
4,142,594 A * 3/1979 Thompson ..... E21B 25/08 175/233

(Continued)

FOREIGN PATENT DOCUMENTS

CN 201723190 1/2011
DE 10346351 12/2004

(Continued)

OTHER PUBLICATIONS

International Search Report for PCT/EP2012/071046, English translation attached to original, Both completed by the European Patent Office dated Apr. 19, 2013, All together 5 Pages.

(Continued)

*Primary Examiner* — Michael R Wills, III
(74) *Attorney, Agent, or Firm* — Brooks Kushman P.C.

(57) ABSTRACT

A round-trip autoclave sample-extracting device for extracting a sample at a sample extraction location of a geological formation, the device includes a self-closing pressure chamber module for receiving the sample. The pressure chamber module is connected to a lifting module in order to lift the sample into the pressure chamber module in one sampling stroke. The round-trip autoclave sample-extracting device has a triggering module and a pressure regulating module, the triggering module acting on the lifting module in order to trigger the sampling stroke, and the pressure regulating module is coupled to the pressure chamber module at least on the pressure side after the sampling stroke in order to influence a pressure in the pressure chamber module. A round-trip method is proposed which includes a first trip and (Continued)

at least one second trip for extracting a sample while maintaining a pressure that is present at the sample extraction location.

18 Claims, 13 Drawing Sheets

(56) References Cited

U.S. PATENT DOCUMENTS

| | | | | |
|---|---|---|---|---|
| 4,230,192 | A * | 10/1980 | Pfannkuche | E21B 25/08 175/233 |
| 4,312,414 | A | 1/1982 | Park | |
| 4,317,490 | A | 3/1982 | Milberger et al. | |
| 5,482,123 | A | 1/1996 | Collee | |
| 6,216,804 | B1 | 4/2001 | Aumann et al. | |
| 6,505,693 | B1 * | 1/2003 | Looijen | E21B 25/04 175/249 |
| 2002/0033281 | A1 | 3/2002 | Aumann et al. | |

FOREIGN PATENT DOCUMENTS

| | | |
|---|---|---|
| DE | 102008047905 | 4/2010 |
| GB | 205009 | 10/1923 |
| GB | 547065 | 8/1942 |
| GB | 2000824 | 1/1979 |

OTHER PUBLICATIONS

Paull et al. Natural Gas Hydrates, Occurrence, Distribution and Detection, AGU Geophysical Monograph 124, 2001, p. 53-65, "History and Significance of Gas Sampling During DSDP and OPD Drilling Associated with Gas Hydrates."

Wallace et al. Proceedings of the Ocean Drilling Program, Scientific Results 2000, vol. 164, p. 101-112, "10. Effects of Core Retrieval and Degassing on the Carbon Isotope Composition of Methane in Gas Hydrate- And Free Gas-Bearing Sediments From the Blake Ridge."

Waite et al. Journal of Geophysical Research 2008, vol. 113, 12 Pages, "Physical property changes in hydrate-bearing sediment due to depressurization and subsequent repressurization."

Abegg et al. Deep-Sea Research I 2008, vol. 55, p. 1590-1599, "Development and application of pressure-core-sampling systems for the investigation of gas- and gas-hydrate-bearing sediments."

Anders., Public Thesis Defence Aug. 24, 2009, English Summary attached to original document, "Theory and practice of in-situ sampling on the field of maritime technique" Uploaded in three (3) PDF's, Part one (1) is 80 Pages and Part Two (2) is 80 Pages and Part Three (3) 73 Pages, All together 233 Pages.

* cited by examiner

DEVICE AND METHOD FOR EXTRACTING A SAMPLE WHILE MAINTAINING A PRESSURE THAT IS PRESENT AT THE SAMPLE EXTRACTION LOCATION

CROSS-REFERENCE TO RELATED APPLICATIONS

This application is the U.S. national phase of PCT Application No. PCT/EP2012/071046 filed on Oct. 24, 2012, which claims priority to German Patent Application No. 10 2011 085 192.5 filed on Oct. 25, 2011, the disclosures of which are incorporated in their entirety by reference herein.

TECHNICAL FIELD

Apparatus and process for extracting a sample while maintaining a pressure prevailing at the sampling site.

BACKGROUND

The invention relates to a sampling process or a sampling technology and to a sampling apparatus which belongs to the process and will be referred to herein below, for short, as a sampler.

Sampling is the removal of a sample in accordance with a defined process. This serves the purpose of making reliable statements relating to the quality, nature or composition of a certain material. The procedure of removing the material brings forth a sample.

Great interest is attached to so-called "in-situ" sampling, which is becoming more important in present times and which energy and raw-materials companies use for exploring deposits or reservoirs, usually prior to the latter being developed. The expression so-called "in-situ" sampling means, in the branch of geological science relating to this patent application, sampling "on site" while maintaining essential environmental variables, in particular the main parameters of pressure and temperature. Importance is placed here not just on maintaining the parameters, but also on obtaining an intact sample with minimal contamination.

Conventional sampling techniques which are known at present lack accurate renderings of the true actual values of the sample. This is reported in [Anders, Erik: Theorie and Praxis der "in-situ" Probenahme in der maritimen Technik [theory and practice of maritime "in-situ" sampling], Dissertation at the Technical University of Berlin, 2009] and [Paull C. K., Ussler III W. (2000): "History and significance of gas sampling during DSDP and ODP drilling associated with gas hydrates" In: Paull, C. K., Dillon, W P. (Eds.), Natural Gas Hydrates: Occurrence, Distribution and Detection. Am. Geophys. Union, Washington, D.C., pp. 53-65] and also [Wallace P. J., Dickens G. R., Paull C. K., Ussler W. III (2000): "Effects of core retrieval and degassing on the carbon isotope composition of methane in gas hydrate- and free gas-bearing sediments from the Blake Ridge" In: Paull, C. K., Matsumoto, R., Wallace, P. J., and Dillon, W. P. (Eds), Proc. ODP, Sci. Results, 164: College Station, Tex. (Ocean Drilling Program), 101-112. doi: 10.2973/odp.proc-s.sr.164.209.2000]. According to these reports, the samples undergo irreversible changes during the recovery periods, and are subject to the fundamental influence of vastly altered environmental conditions, and therefore a large number of biochemically and physically conditioned processes are exposed to irrevocable alterations and are therefore unusable for some research, as is reported in [Waite W. F., (2008): "Physical property changes in hydrate-bearing sediment due to depressurization and subsequent repressurization" Lawrence Berkeley National Laboratory (University of California, University of California), Year 2008 Paper LBNL-664E].

It is precisely in the field of new technologies that there is a major need for accurate information relating to a deposit, the conventional methods being insufficient, or unable, to provide this information. An example of such new technologies is constituted by the recovery of gases from coal-seam deposits or from low-permeability deposits or the recovery of gas hydrates for example methane hydrate.

Information relating to the construction or the composition of a geological formation is, for example, also required in preliminary investigations of potential reservoirs for storing CO2.

[Abegg F., Hohnberg H.-J., Pape T., Bohrmann G., Freitag J. (2008): "Development and application of pressure-core-sampling systems for the investigation of gas- and gas-hydrate-bearing sediments" Deep Sea research Part I: Oceanographic Research Papers, Deep-Sea research I 55: 1590-1599] describes, for example, how to investigate highly unstable gas hydrates, which quickly decompose under changes in pressure and temperature.

So-called "autoclave samplers" are used here for recovering and investigating soil samples while maintaining the prevailing "in-situ" conditions. The term "autoclave" relates to its literal meaning and refers to the "self-closing" operation of the sampler on site. The "self-closing" operation on site serves for conserving the environmental conditions present, that is to say the "in-situ" conditions. The term "autoclave" here does not relate to the effect of sterilization, as is used in conventional medical/biological applications.

"Autoclave samplers" always follow the same principle: the sampler is positioned at a promising location and extracts the desired sample. The latter is then closed in a pressure-tight and thermally insulated manner on site and then recovered. The essential part of this sequence is the operation of raising the recovered sample material into a pressure chamber, past a lower closure mechanism. The following closure of the autoclave sampler ensures that the environmental conditions prevailing there—"in situ"—are maintained. Such autoclave samplers, in the broadest sense, are disclosed in DE 10 2008 047 905 A1, DE 103 46 351 B2, GB 2 05009 A, GB 2 000 824 A, CN 201 723190 U, U.S. Pat. No. 5,482,123 A, U.S. Pat. No. 6,216,804 B1 and US 2002/0033281 A1.

A sampling technology which is currently used in deep drilling makes use of autoclave samplers which are capable of self-closing at the sample-extraction site, and therefore the environmental conditions present on site, in particular pressure and temperature parameters, can be conserved until investigation of the sample takes place or investigation of the sample has been completed. This sampling technology is the so-called "wire-line process". An autoclave sampler here is let down within the drill string and docks in the lower part of the drill string [Bottom Hole Assembly], directly above the drill bit. Following sampling and the operation of raising the sample into a pressure chamber of the autoclave sampler, the sampler is recovered again with the aid of a long cable. Disadvantages of this process, however, are constituted by the dimensions of the pressure sampler, which are very limited by the drill string, and, for example, the small core diameter of the sample which is the result of using a sampler-closing ball valve which takes up a lot of space. The autoclave sampler with such a ball valve and also the associated "wire-line process" are described, for example, in U.S. Pat. No. 4,317,490 A.

So-called "rotary drilling", which has been known for some time now, is used for deep-drilling purposes. The process is distinguished essentially in that a drill hole having a drill-hole floor is drilled. The main element for carrying out the process is formed here by a drill string, which extends from a surface to the lowermost location of the drill hole and, despite a comparatively small overall diameter of 10 to 20 cm, may be a number of kilometers in length. The drill string is subdivided into a multiplicity of sub-segments and is sunk down from the drill rig. The drill string is usually driven from the drill rig, from where it is moved both in translatory and in rotary fashion. Advancing movement and rotational drilling speed are realized and regulated in this way. The drill bit is located at the lower end of the drill string, this drill bit having different cutting mechanisms, depending on the soil or type of rock, and being drawn out of the drill hole together with the drill bit at the end of the drilling operation. Controlled flushing of the drill bit and of the drill string is extremely important for a successful drilling operation. A pump delivers the flushing medium through the drill string, directly to the drill bit, where the drill cuttings removed are transported to the surface by way of the annular space produced between the drill string and drill-hole wall. This avoids any blockage of the drill hole. After filtering processes, the flushing medium can be returned into the circuit. In order to change the drill bit or to introduce and remove components which are guided at the bottom of the drill string, for example measuring instruments, drilling motors, core drills or the like, the entire drill string is removed and, once the corresponding components have been mounted at the lower end, introduced again. This operation of removing the entire drill string and introducing it again is referred to as a "round trip".

Proceeding from the prior art mentioned, it is an object of the invention to develop a sampling technology and a sampling apparatus which make it possible to extract a sample while maintaining the environmental conditions prevailing at the sampling location—"in situ"—, the intention being to overcome the aforementioned disadvantages.

The sample-extracting process and the sampling apparatus should ensure not just that the environmental conditions prevailing at the sampling location are maintained, but also that an essentially intact sample, that is to say one which is not contaminated to any significant extent, is obtained.

In conjunction with the novel procedure in the novel two-stage "round-trip process", which will be presented herein below, the following description of the invention also refers to the sampler according to the invention as a "round-trip autoclave sampler". The "round-trip autoclave sampler" is suitable, in particular, for use within the novel round-trip process.

Use beyond the round-trip process, however, is not ruled out. Individual modules of the round-trip autoclave sampler may also be used, independently of the round-trip process, in other sampling processes or other autoclave samplers.

SUMMARY

The starting point for the invention is the known "round-trip process".

The process for extracting a sample at a sampling site in a geological formation by means of a drilling installation comprising a drill string and an end-side drill bit involves, in a stepwise manner, a first trip, in which, first of all, a drill hole having a drill-hole floor is drilled and, secondly, the drill string with the drill bit is removed from the drill hole again.

The invention provides a second trip, in which, in a stepwise manner, thirdly, the sampler is mounted between the drill string and drill bit, fourthly the drill string and the sampler and the drill bit are introduced into the drill hole, fifthly, in the drill hole, the sample is drilled from the previously drilled drill-hole floor, the sample passing into a housing of the sampler, whereupon either a detachment displacement and a sample displacement are triggered and carried out in a single displacement action combining a sixth and seventh step, during which the sample is separated from the geological formation and during which the housing, with the sample, is raised into a pressure chamber of the sampler and positioned between a first and a second sealing element of the pressure-chamber module, or, sixthly, the detachment displacement during which the sample is separated from the geological formation, and then, seventhly, the sample displacement, during which the housing, with the sample, is raised into a pressure chamber of the sampler and positioned between a first and a second sealing element of the pressure-chamber module, are triggered and carried out, eighthly, the sample is closed in a pressure-tight manner by virtue of the two sealing elements of the pressure chamber of the sampler being closed, wherein the pressure chamber can be influenced on the pressure side during or following the closing operation, ninthly, the drill string along with the sampler and the drill bit are removed from the drill hole, tenthly, the sampler, with the sample located in the pressure-tight pressure chamber, is separated from the drill string and the drill bit.

An "autoclave sampler" is used in order to carry out the process. Known "autoclave samplers" suitable for carrying out the process can be used within the novel process.

The novel "round-trip autoclave sampler" for extracting a sample at a sampling site of a geological formation comprises a self-closing pressure-chamber module for accommodating the sample, wherein the pressure-chamber module is connected to a lifting module in order to raise the sample in a sample-displacement action into the pressure-chamber module.

The invention provides for the autoclave sampler to have a triggering module and a pressure-regulating module, wherein the triggering module acts on the lifting module in order to trigger the sample displacement and the pressure-regulating module, following the sample displacement, is coupled to the pressure-chamber module, at least on the pressure side, in order to influence a pressure in the pressure-chamber module.

In a first configuration, the pressure-chamber module for accommodating the sample is an automatically self-closing one or, in a second configuration, it is one which closes by remote triggering.

In the case of automatic closure of the pressure-chamber module of the sampler, mechanisms arranged in the sealing elements of the pressure-chamber module are freed in relation to one another by movements of certain moving components of the modules of the sampler. Initiation takes place automatically without any further intervention from outside. The description will explain this in more detail.

In the case of remotely triggered closure of the pressure-chamber module of the sampler, mechanisms arranged in the sealing elements of the pressure-chamber module are freed in the first instance from outside. Initiation, rather than being automatic, takes place only with intervention from outside. The description will explain this in more detail.

In a preferred configuration of the invention, a first pressure-regulating module comprises a quick-coupling mechanism which, in its coupled position, frees a fluid and gas space arranged in a lifting rod of a lifting module, wherein a gas in a gas space of the fluid and gas space expands and a fluid supplied in a fluid space of the fluid and gas space, and subjected to pressure by the gas, is freed.

In another preferred configuration of the invention, a second pressure-regulating module comprises a displacement sleeve which is seated on a bearing and, in its coupled position, likewise frees a fluid and gas space arranged in a lifting rod of a lifting module, wherein, analogously, a gas in a gas space of the fluid and gas space expands and a fluid supplied in a fluid space of the fluid and gas space, and subjected to pressure by the gas, is freed.

Basically mechanical, physical, chemical and electrical mechanisms are proposed in order to trigger and carry out the displacement. Use can be made of spring elements, electromechanical, hydraulic and pneumatic drives and chemical reactions, piezoelectric actuators and shape-memory alloys configured as drives.

It is preferred, in one configuration, if a first triggering module has a drop-ball seat which is connected directly or indirectly to a blocking element of a lifting-spring element of a lifting module, wherein triggering takes place by way of an object of mass, in particular by way of a drop ball, which temporarily blocks a flushing stream in the sampler, as a result of which the blocking element is moved radially and a lifting rod of the lifting module is freed and shifted by the sample displacement, as a result of which the lifting module assumes its triggered position, that is to say its end position in which it has been triggered in relation to its non-triggered starting position (non-triggered position).

In another preferred configuration, a second triggering module comprises a first and a second housing part, which are connected to one another in an axially movable manner via a spline-shaft connection, wherein an axial flow of forces from the first housing part to the second housing part is transmitted by a disk-spring assembly, wherein the first housing part is connected to a drill string and the second housing part is connected directly or indirectly to a blocking element of a lifting-spring element of a lifting module, wherein triggering takes place by way of the drill string being compressed axially, as a result of which the blocking element is moved radially and a lifting rod (V) of the lifting module is freed and shifted by the sample displacement, as a result of which the lifting module assumes its triggered position, that is to say its end position in which it has been triggered in relation to its non-triggered starting position (non-triggered position).

In yet another preferred configuration of the invention, a third triggering module comprises a roller which activates a valve which closes a pressure space of a lifting module, wherein the third triggering module has a drop-ball seat which belongs to a first or a second housing part, wherein the first housing part is subjected to positive guidance in relation to a second housing part, or vice versa. The housing parts are components which are not rotationally symmetrical, and they have, for example, a polygonal profile. The housing parts are connected to the roller via grooves and pins, and therefore a translatory movement of the first or second housing part results in a rotary movement of the roller, and of the valve connected to the roller and vice versa, wherein triggering takes place by way of an object of mass, in particular by way of a drop ball on the drop-ball seat, said drop ball temporarily blocking a flushing stream in the profile roller, as a result of which the valve opens the pressure space, and a lifting-spring element of a lifting module moves a piston, which is connected to the pressure space, axially in the direction of the expanding pressure space, as a result of which a lifting rod of the lifting module is freed and shifted by the sample displacement, as a result of which the lifting module likewise assumes its triggered position, that is to say its end position in which it has been triggered in relation to its non-triggered starting position (non-triggered position).

Finally, a first and second lifting module, in a preferred configuration, is designed so as to have a lifting-spring element which, in a non-triggered position, is located in a stressed state and, in the triggered position, is located in a prestressed state and of which the spring force stored in the stressed state, following triggering by one of the triggering modules, forces the sample displacement, the triggered position being assumed in the process, wherein the lifting-spring element is operatively connected to the lifting rod, which, for its part, is connected to the pressure-chamber module.

With the aid of such a "round-trip autoclave sampler", in a preferred configuration of the invention, the sampling-site pressure in the pressure chamber of a pressure-chamber module of the sampler following closure of the two sealing elements of the sampler is influenced during the recovery operation, and also following the recovery operation until such time as the sample is investigated and beyond, by a pressure-regulating module, which is integrated in a sampler.

The pressure-regulating module has previously been charged, that is to say preadjusted, to a positive pressure. The pressure is greater (positive pressure) than the pressure prevailing in the sampling environment, as a result of which a desired pressure surrounding the sample is adjusted in the pressure chamber of the pressure-chamber module, and therefore this adjusted pressure coincides with the pressure prevailing at the sampling site or else is greater than this pressure.

The pressure in the fluid and gas space within the pressure-regulating module is preadjusted in accordance with the determination of the necessary pressure in the fluid and gas space. The pressure in the fluid and gas space within the pressure-regulating module is preadjusted before the sampler 1 is introduced into the drill hole B.

Provision is made for pressure regulation to be effected by a connection, which is established in a coupled position, between the fluid and gas space of the pressure-regulating module and the pressure-chamber module.

Provision is also made for pressure regulation to be controlled, via the sample displacement of the lifting module, by the connection, which is established in a coupled position, between the fluid and gas space of the pressure-regulating module and the pressure-chamber module, as will be explained in yet more detail in the exemplary embodiment.

The sample displacement of the lifting module is triggered, according to the invention, by a triggering module, wherein the point in time at which pressure regulation starts is controlled by the sample displacement taking place following the triggering operation.

The triggering module itself is activated, according to the invention, in various ways.

In one configuration, it is proposed to activate a first and third triggering module with the aid of an object of mass, in particular a drop ball.

In a further preferred configuration, it is proposed to activate a second triggering module by virtue of the drill string being compressed.

The process is also distinguished, in a preferred configuration, by the coupling of a first pressure-regulating module to the pressure-chamber module—in a first coupling mode—once the pressure-chamber module has been fully closed at the upper and lower ends with the aid of the respective sealing elements.

Another preferred configuration provides for the coupling of a second pressure-regulating module to the pressure-chamber module—in a second coupling mode—just prior to the second, upper sealing element being closed, once the first, lower sealing element has already been fully closed.

The coupling of the first or second pressure-regulating module to the pressure-chamber module brings about, inter alia, an initial preliminary pressing action of the sealing elements against their associated sealing seat, this ensuring reliable pressure sealing of the pressure-chamber module.

The respective pressure-regulating module advantageously ensures, in the first instance, that, during the recovery operation, pressure equalization takes place and thus pressure is maintained in the pressure-chamber module, and therefore the pressure prevailing at the sampling site is still present at the site where the sample is investigated.

The pressure-regulating module also ensures, if desired, that, during the recovery operation and beyond, pressure is regulated in the pressure-chamber module to the extent where, at the site where the sample is investigated, the pressure in the pressure-chamber module is greater than at the sampling site.

Finally, the pressure-regulating module, as mentioned, ensures reliable pressure sealing of the pressure-chamber module, since the coupling of the respective pressure-regulating module to the pressure-chamber module brings about an initial preliminary pressing action of the sealing elements in order to seal the pressure-chamber module.

The invention will be explained herein below with reference to the associated figures. The schematic illustrations and components, in some cases, are not true to scale.

Use is made of size ratios which render a basic description possible.

BRIEF DESCRIPTION OF THE DRAWINGS

In the figures:

FIG. 1I-1 shows a drill-string configuration made up of a drill string and drill bit with the schematically illustrated sampler integrated;

FIGS. 3A-1 and 3A-2 show a first variant of a triggering module of the sampler;

FIGS. 3B-1 and 3B-2 show a second variant of the triggering module of the sampler;

FIGS. 4A-1 and 4A-2 show a first variant of a lifting module of the sampler;

FIGS. 5B-1 and 5B-2 show a second variant of a pressure-regulating module (accumulator module) of the sampler;

FIGS. 6A-1, 6A-2 and 6A-3 show an opening and closing mechanism in the manner of a profile roller for opening and for closing a valve of a third variant of a triggering module of the sampler;

FIGS. 7A-1 and 7A-2 show an enlarged illustration of a sealing element.

DETAILED DESCRIPTION

In the first instance, the round-trip process according to the invention will be explained, schematically, with reference to FIGS. 1A-1E.

Conventional Round-Trip Process:

The drilling installation 500, which will be described herein below, and the associated process may be arranged, as illustrated, continentally directly on a geological formation which is to be investigated or offshore on a ship or the like.

Figures 1A, 1B, 1C, 1D, 1E:
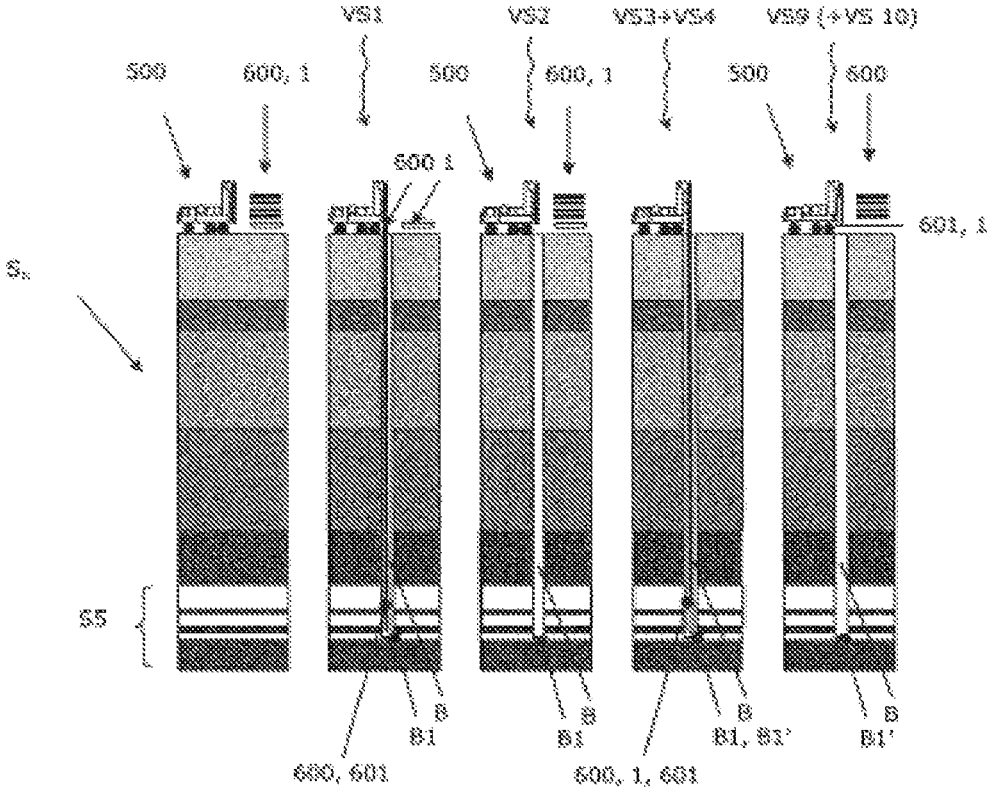
FIGS. 1A-1E show schematic illustrations of the steps for carrying out the round-trip process.

FIG. 1A shows a geological formation with different layers Sn (n=1, 2, 3, etc.). A sampling environment is located, for example, in a fifth layer S5 (n=5) of the geological formation. A drilling installation 500 with associated drill string 600, which comprises a plurality of sub-segments, is brought into position above the geological formation.

The novel round-trip process comprises a first, known trip and at least one second, novel trip. The first trip comprises a first and second, already known process step, whereas the second trip, according to the invention, comprises further process steps (process steps VS3 to VS10). It is becoming clear that a "trip" is understood to mean a defined sequence made up of a number of process steps.

Deep drilling is carried out in a first step VS1 (FIG. 1B). The drill hole B is drilled to an envisaged depth. The main element involved in deep drilling is formed, as FIG. 1B shows, by the drill string 600, by means of which the drill hole B is drilled to the envisaged depth of the environment from which the sample is to be extracted.

The drill string 600 is driven by the drilling installation 500, from where the drill string 600 is moved both in a translatory and in a rotary fashion. Advancing movement and rotational drilling speed of the drill string 600 are realized by the drilling installation 500 and regulated thereby. A drill bit 601 is located at the end of the drill string 600, this drill bit having different cutting mechanisms, depending on the soil or type of rock in the layers Sn. Controlled flushing is carried out for deep drilling. A pump delivers the flushing medium through the drill string 600, directly to the drill bit 601, wherein the drill cuttings removed are transported to the surface by way of the space, the so-called annular flushing space B2 (FIGS. 1F to 1I), produced between the drill string 600 and drill-hole wall.

FIG. 1B shows the drilling of the drill hole B, of which the drill-hole floor B1 is arranged just above the level at which the actual sampling operation should take place at a later stage.

In a second step VS2, once the drill hole B has been drilled to the desired sample depth, the drill string 600 together with the drill bit 601 is removed. The resulting state—an open drill hole B—is illustrated in FIG. 1C. The process steps VS1 and VS2, drilling the drill hole B by introducing the drill string 600 with drill bits 601 and removing the drill string 600 and the drill bit 601, according to FIGS. 1A to 1C, characterize the already known round-trip process.

Novel Round-Trip Process:

In the novel, two-stage round-trip process according to the invention, in a third step VS3, a sampler 1 with a drill bit 601 is mounted on that sub-segment of the drill string 600 which is the first to be introduced again. This mounting operation means that the sampler 1, which is installed between the drill bit 601 and drill string 600, becomes an integral constituent part of the drilling installation 500 or of the drill string 600.

Figures 1F, 1G, 1H, 1I:
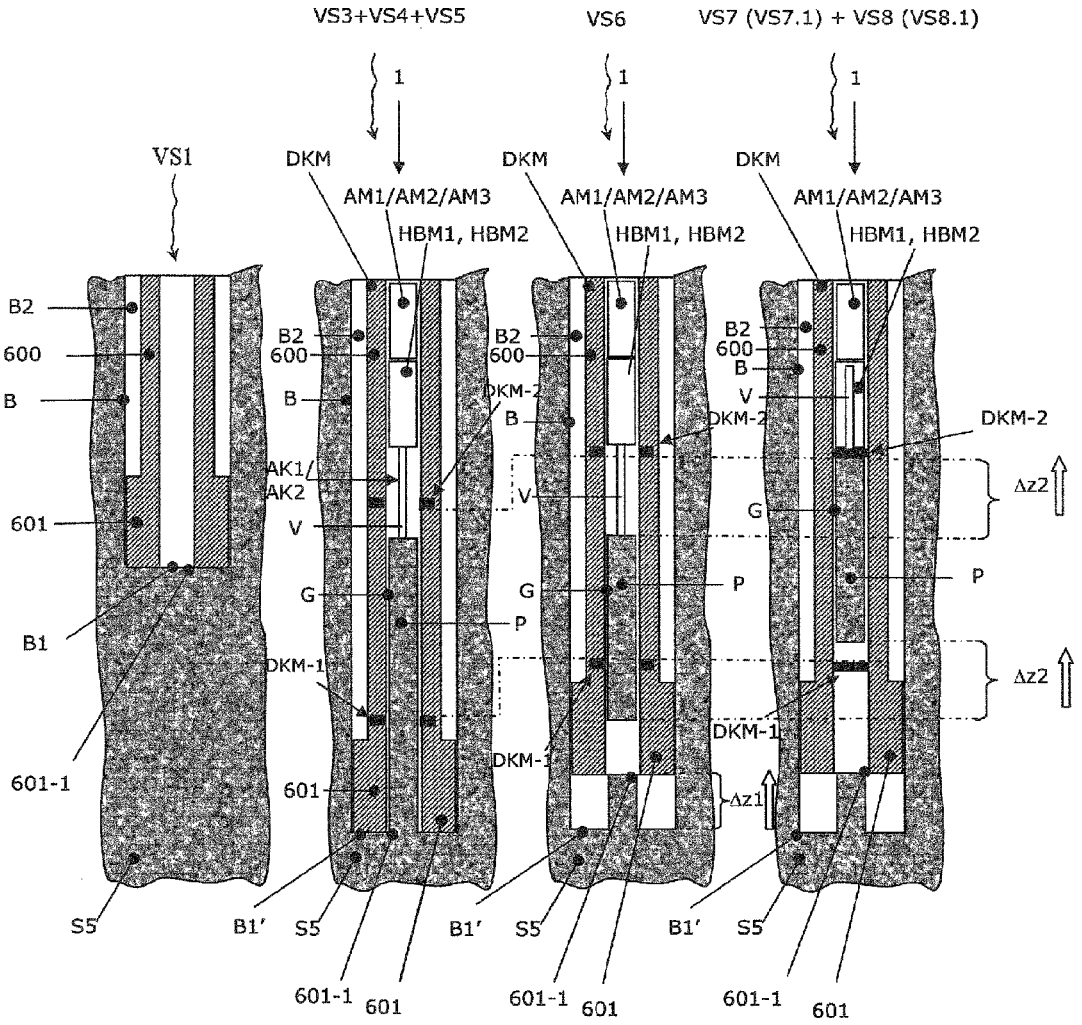
FIGS. 1F-1I show a schematic illustration of a sampler, the round-trip autoclave sampler, for the purpose of explaining the basic function of the sampler during the steps of the round-trip process.

The resulting drill-string configuration 600, 1, 601, the drill string 600, usually comprising a plurality of sub-segments, the sampler 1, which is arranged between the drill string 600 and the drill bit 610, and the drill bit 601 are then, in a fourth step VS4, according to FIG. 1D, introduced into the drill hole B, until the drill bit 601 has reached the original drill-hole floor B1 drilled in the first step (FIG. 1F).

This is followed in a fifth step VS5, as FIG. 1G shows, by the sample P being drilled, the drill bit 601 being subjected to a defined pressure via the drill rods of the drill string 600, whereupon the drill-string configuration 600, 1, 601 penetrates deeper into the fifth layer S5 which is to be investigated, and therefore the drill hole B forms a lower-level sampling drill-hole floor B1'.

Following completion of the drilling operation carried out in the fifth step VS5, the drilled sample P, also referred to as drilled sample core or just as drill core, is located in the drill bit 601 and still in the lower region of the sampler 1 (FIG. 1G) in a sleeve-like housing G of the sampler 1, wherein the housing G will also be referred to herein below as a liner.

The drilled drill core P, however, is still connected to the environment surrounding the sampling drill-hole floor B1'. Following a sixth step VS6, involving a detachment displacement (transition from FIG. 1G to 1H), during which all the drill rods 600 are raised somewhat by an amount Δz1, the sample P detaches from the sampling environment at a defined predetermined breaking point.

In a seventh step VS7, as shown in FIG. 1I, (transition from FIG. 1H to 1I), the sample P recovered on site "in situ" is raised into a pressure-chamber module DKM in a sample-displacement action Δz2 triggered by a triggering module AM1, AM2, AM3, wherein the pressure-chamber module DKM, which constitutes essentially a pressure chamber, then automatically closes in an eighth step, which is likewise shown in FIG. 1I, whereupon the pressure chamber of the pressure-chamber module DKM is influenced on the pressure side by a pressure-regulating module AK1, AK2, and therefore the sample P is "autoclaved", in the sense already described for this patent application, in the pressure-chamber module DKM of the sampler 1, the pressure prevailing at the sampling site being maintained in the process.

As an alternative, it is proposed for the detachment displacement Δz1, during which the sample P is separated from the geological formation, and the sample displacement Δz2, during which the housing G, with the sample P, is raised into a pressure chamber of the sampler 1 and positioned between a first and a second sealing element DKM-1, DKM-2 of the pressure-chamber module DKM, to be combined in a single displacement action Δz1+Δz2. In this alternative solution, both the detachment displacement Δz1 and the sample displacement Δz2 are carried out by a first or second lifting module HBM1, HBM2, which will be described in yet more detail herein below.

The provided automatic closure of the pressure-chamber module DKM, which will also be explained in detail herein below, constitutes the eighth step VS8, wherein, in this eighth step VS8, it is ensured that the sample P is closed in a pressure-tight manner and is regulated on the pressure side by a pressure-regulating module AK1, AK2 during or after the closing operation. The sample here remains closed in a pressure-tight manner until the recovery operation and beyond, that is to say until the sample P is investigated, and thus, during the investigation, still has the pressure which prevails "in situ" at the sampling site, wherein the pressure regulation makes it possible to effect a pressure in the pressure chamber at the investigation site which is higher than the pressure prevailing originally at the sampling site.

In a ninth step VS9, according to FIG. 1E, the entire drill-string configuration 600, 1, 601 is removed from the drill hole B again. The drilled drill core P is located in the liner G of the pressure-chamber module DKM, the drill core having been extracted "in situ" and having the environmental conditions, in particular the environmental pressure of the sampling location or a higher pressure than that of the sampling location, for which reason the drill core P is also referred to as a pressure core, pressure drill core or pressure core sample.

Following the recovery operation, in a tenth step VS10, the sampler 1, to which the pressure-chamber module DKM belongs, is separated (not illustrated specifically) from the drill-string configuration 600, 601 at the surface and can be used for the desired investigations. FIG. 1E shows the empty drill hole B with the reusable drill-string configuration 600, 601 removed and with the associated drilling installation 500, on which the sampler 1 is still mounted.

The stepwise procedure described characterizes the novel two-stage round-trip process, which is also distinguished in that the axial and rotary movements of the drill rods of the drill string 600 are transmitted to the drill bit 601 via the sampler 1. The sampler 1, in the second trip, becomes an integral constituent part of the drill-string configuration 600, 1, 601.

The advantages of the novel, two-stage round-trip process consist in that pressure-tight "in-situ" pressure cores P can be recovered by means of at least one further round trip within the second trip. A number of repeated round trips, within the framework of the second trip, make it possible to recover further pressure cores P at lower-level sampling locations in the same drill hole B. At the investigation site, irrespective of the pressure prevailing there, the pressure core P here is still at the environment pressure prevailing at the sampling location and still has the other characteristics of the layers or strata.

The advantages of the two-stage round-trip process also consist in that a greater sample volume is achieved in comparison with the "wire-line process" described in the prior art since, in the case of the round-trip process, in contrast to the "wire-line process", the internal drill-string diameter does not limit the external diameter of the sampler. This is clarified by FIG. 1I-1. Using different closure mechanisms, for example a flap instead of a ball valve, likewise makes it possible to recover samples with larger external diameters $d_{P-a}$.

In particular when the internal drill-string diameter $d_{600-i}$ is very small, the "wire-line process" cannot recover a usable sample. The samplers used therein require, for the purpose of extracting pressure-tight samples from a great depth, thick pressure-vessel walls and closure mechanisms which take up a lot of space, and therefore the samplers cannot be guided to the sampling location via the internal drill-string diameter $d_{600-i}$.

The novel round-trip process manages, relative to a desired external sample diameter $d_{P-a}$, with a relatively small drill-hole diameter, since the external diameter of the pressure chamber of the pressure-chamber module DKM—taking account of the necessary annular flushing space B2—is limited exclusively by the drill-hole diameter $d_B$, which corresponds to the external drill-bit diameter $d_{601-a}$.

This means that the novel round-trip process described here makes it possible to maximize the internal pressure-chamber diameter $d_{DKM-1}$ in relation to the external drill-string diameter $d_{600-a}$ and/or the external drill-bit diameter $d_{601-a}$, as a result of which it is possible to recover a sample with the largest possible external diameter $d_{P-a}$, which corresponds essentially to the internal diameter $d_{DKM-1}$ of the pressure-chamber module DKM.

The advantage is achieved, in particular, since the drill string 600, the sampler 1 and the drill bit 601 form a unit. This is because the sampler 1 is arranged between the drill string 600 and the drill bit 601. For this purpose, the sampler 1 (see FIG. 1I-1 and FIG. 8) has connections which, in a preferred configuration, are designed in the form of adapter-like connections 602, 604 and serve for connecting the sampler 1 to the drill string 600, on the one hand, and to the drill bit 601 on the other hand.

The novel round-trip process thus makes it possible to maximize the internal diameter $d_{DKM-1}$ of the pressure-chamber module DKM in relation to the external drill-string diameter $d_{600-a}$, as a result of which the largest possible external sample diameter $d_{P-a}$ is achieved.

The external sample diameter $d_{P-a}$ can advantageously be selected independently of the internal drill-string diameter $d_{600-i}$. The internal diameter $d_{DKM-1}$ of the pressure-chamber module DKM here may be selected to be smaller than the internal drill-string diameter $d_{600-i}$. However, it may also advantageously be larger than the internal drill-string diameter $d_{600-i}$. This option, as explained above, is ruled out from the outset in the known "wire-line process", since the sampler is introduced into the drill string.

To summarize, it is therefore an advantage of the sampler 1 according to the invention that the external sample diameter $d_{P-a}$, which corresponds essentially to the internal pressure-chamber diameter $d_{DKM-i}$ of the pressure-chamber module DKM, can be increased in relation to the prior art, wherein the maximum external sample diameter $d_{P-a}$ is obtained by taking account of the respective drill-hole diameter $d_B$ minus the annular flushing space B2 required and minus the required thickness a of the wall of the pressure-chamber module DKM, this wall thickness being dependent on depth and/or being necessary for the maximum operating pressure of the pressure-chamber module DKM.

The mouth 601-1 of the drill bit 601 with the internal drill-bit diameter $d_{601-i}$ is coordinated with the respective external sample diameter $d_{P-a}$, and it is therefore possible to drill a sample with the maximum external sample diameter $d_{P-a}$.

The novel round-trip process is also recommended, in particular, when the upward and downward movement of equipment within the drill string and the resulting piston action are undesirable. Such upward and downward movement is caused disadvantageously by the samplers, fitted on the recovery cable, which have to be introduced and removed again in the "wire-line process". It is sometimes also the case that it is not even possible for recovery cables to be introduced and removed, in which case only the round-trip process can be used.

Up until now, the description of the process has dealt only with the pressure-chamber module DKM of the sampler 1.

Novel Round-Trip Autoclave Sampler:

It is also proposed to form a sampler 1 which, in contrast to the prior art, has no closure mechanism for the pressure-chamber module DKM which takes up a lot of space, and this will be discussed in more detail at a later stage in the text.

The sampler 1 according to the invention ensures that the pressure core P passes into the pressure-chamber module DKM, wherein the sampler 1 closes the pressure-chamber module DKM in a pressure-tight manner by specific means—in other words "autoclaves" the same. Such a "round-trip autoclave sampler 1" according to the invention will be explained in more detail herein below, where it will be referred to, for short, just as an autoclave sampler 1.

Figure 2:
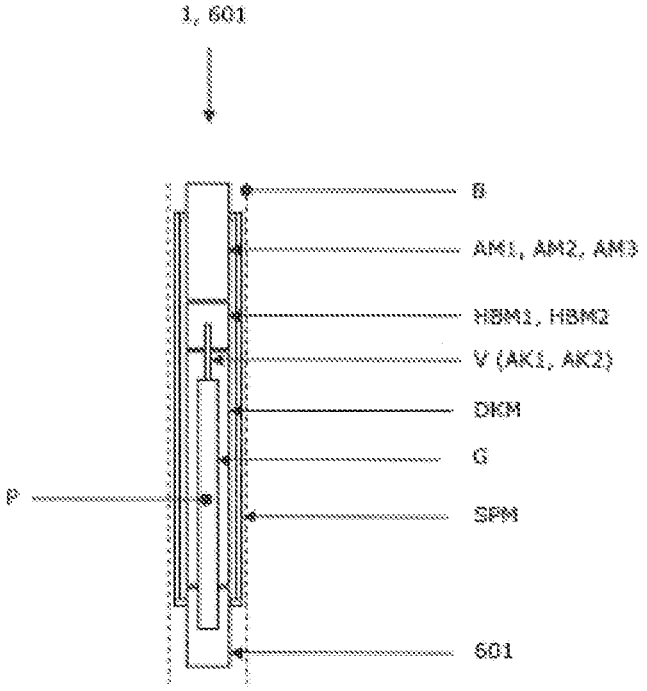
FIG. 2 shows a schematic illustration of the modular-construction sampler for the purpose of illustrating the individual modules.

In order to be able to perform the above described functions within the two-stage (first stage=first trip and second stage=second trip) round-trip process, the autoclave sampler 1, as shown in a highly schematic manner in FIG. 2, has the pressure-chamber module DKM, a pressure-regulating module (accumulator module) AK1, AK2, a triggering module AM1, AM2, AM3, a lifting module HBM1, HBM2 and a flushing module SPM, wherein the pressure core P, once drilled, is arranged in the sleeve-like thin-walled liner G, which has an external diameter $d_{G-a}$ (FIG. 1I-1) which is smaller than the internal pressure-chamber diameter $d_{DKM-i}$.

A connecting element V in the manner of a lifting rod, in which is arranged the respective pressure-regulating module (accumulator module) AK1, AK2, is arranged between the respective triggering module AM1, AM2, AM3 and the respective lifting module HBM1, HBM2 and the pressure sample P.

A description will be given herein below, with a further detailed description of the process steps at the same time, of the sampler 1 for sampling a pressure core P in a pressure-tight manner.

Figures 1, 11:
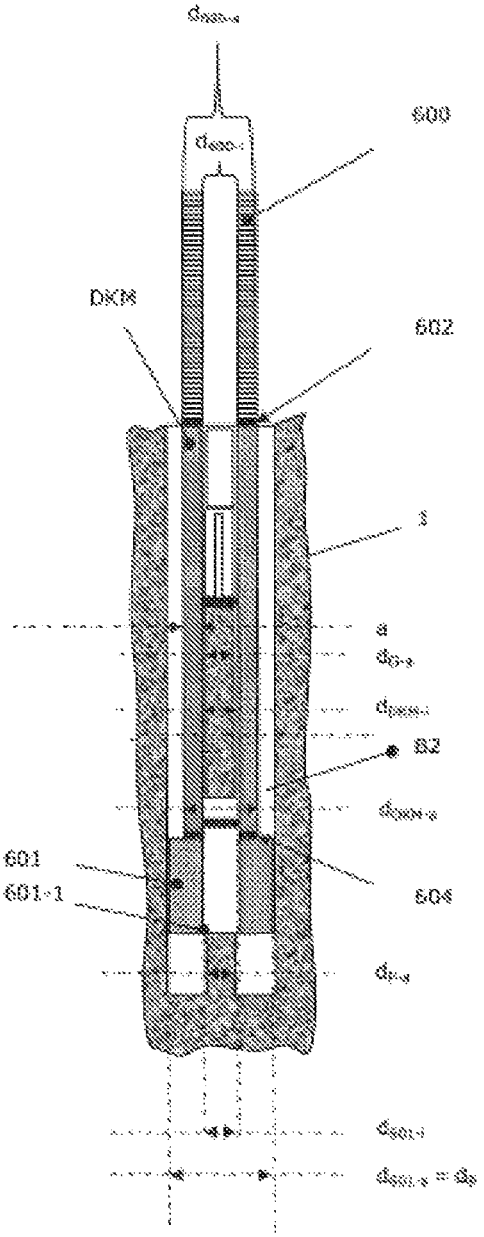
Figures 1, 2, 3A:
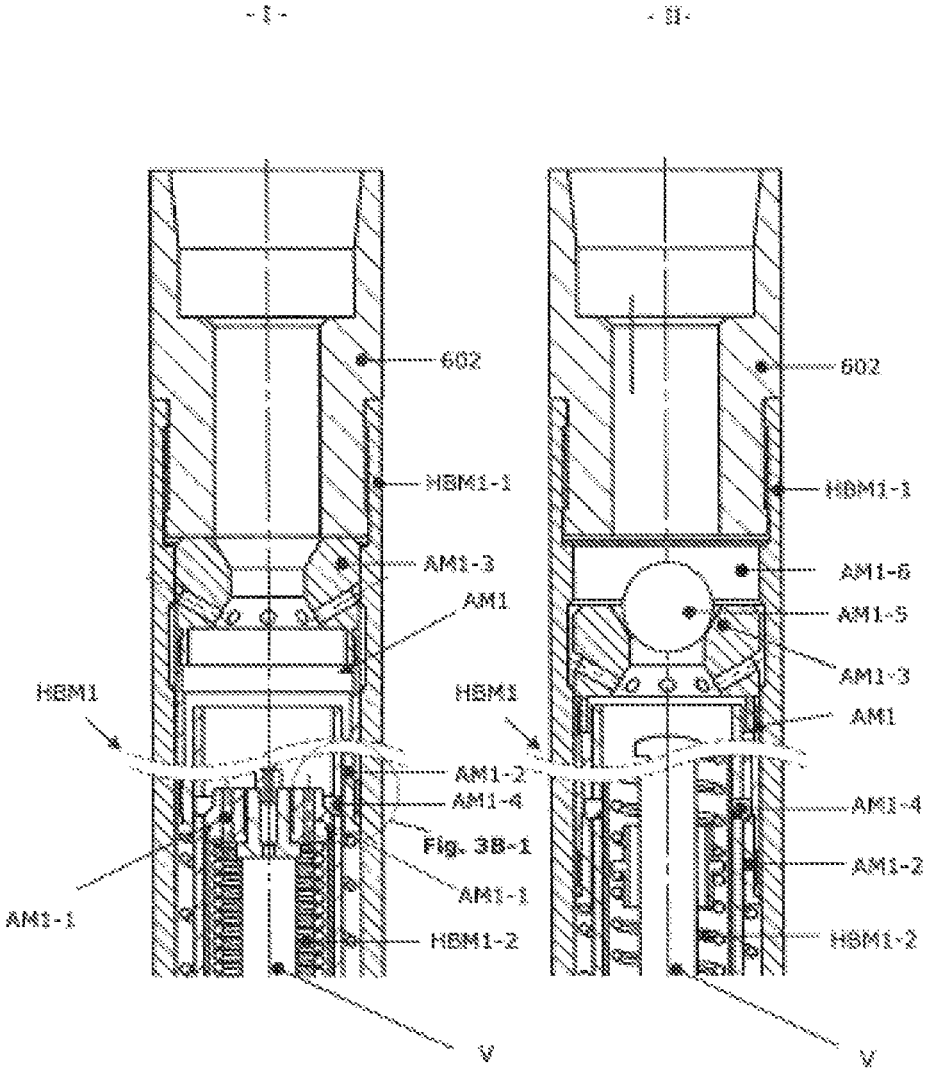

FIGS. 3A-1 and 3A-2 show a first variant of the first triggering module AM1 of the sampler 1 interacting with a first lifting module HBM1.

The operation of carrying out the detachment displacement Δz1 within the sixth step VS6 (FIG. 1H) is followed by the seventh step VS7 (FIG. 1I), in which the pressure core P, located in the liner G, is raised into the pressure-chamber module DKM of the sampler 1 in a sample-displacement action Δz2.

The operation of raising the liner G, together with the pressure core P into the pressure-chamber module DKM comprises a preceding, first sub-step VS7.1 as part of the seventh step VS7.

The operation of triggering the lifting mechanism HBM1 takes place previously in the first sub-step VS7.1. It is only then that the actual operation of raising the pressure core P into the pressure chamber of the pressure-chamber module DKM takes place. This is where the sample displacement Δz2 of the liner G, with the pressure core P located therein, into the pressure-chamber module DKM of the sampler 1 takes place.

Then, in the already described eighth step VS8, the pressure chamber of the pressure-chamber module DKM is closed in a pressure-tight manner at its top and its bottom ends with the aid of sealing elements DKM-1, DKM-2 belonging to the pressure-chamber DKM (see, in particular, FIG. 1H and FIG. 1I).

In a first sub-step VS8.1, which follows the eighth process VS8, or while the eighth process step VS8 is being realized, pressure in the pressure-chamber module DKM is influenced in order for the pressure to be ensured on a sustained basis, in particular in order to equalize the pressure during the operation of recovering the pressure chamber of the pressure-chamber module DKM and beyond. As a result, the sampling-site pressure in the pressure chamber of the pressure-chamber module DKM of the sampler 1 following the operation of closing the sealing elements DKM-1, DKM-2 of the sampler 1, or even during this operation, is influenced during the recovery operation and beyond by a pressure-regulating module AK1, AK2 integrated in the sampler 1, as a result of which the pressure of the sample P in the pressure chamber of the pressure-chamber module DKM at the investigation site coincides with the pressure prevailing at the sampling site or is even higher than the pressure prevailing at the sampling site. This function can be performed by the arrangement of a pressure-regulating module AK1, AK2, which is integrated in the novel round-trip autoclave sampler 1.

FIGS. 3A-1 and 3A-2 show the first lifting module HBM1 and the first triggering module AM1 in the non-triggered position I and the triggered position II, which (HBM1) constitutes an energy store which, as a constituent part of the sampler 1, is activated by the first triggering module AM1, whereupon the pressure chamber of the pressure-chamber module DKM self-closes, once the first lifting module HBM1 has performed the necessary lifting movement prior to the pressure chamber being closed.

First Triggering Module AM1:

First sub-step VS7.1 ("triggering of the sample displacement in order to raise the pressure-chamber module DKM") with the first lifting module HBM1 and the first triggering module AM1:

The process steps VS3, VS4, VS5 and VS6 have been completed. In a first instance, the operation of triggering the first lifting module HBM1 takes place in the first, preceding sub-step VS7.1 of the seventh process step VS7, said lifting module being connected via an adapter piece 602 to those drill rods of the drill string 600 which are located above the adapter piece 602. The drill rods of the drill string 600 have a flushing stream flowing through them.

In the non-triggered position I of FIG. 3A-1, the flushing stream is uninterrupted. The first triggering module AM1, in this variant, is integrated in the first lifting module HBM1.

The first triggering module AM1 has a drop-ball seat AM1-3. In the exemplary embodiment, this drop-ball seat AM1-3 is connected indirectly to a blocking sleeve AM1-2. The drop-ball seat AM1-3, and with it the blocking sleeve AM1-2, is arranged such that it can be displaced in the axial direction in relation to a tapered-ring segment AM1-4. In the non-triggered position I, the tapered-ring segment AM1-4 constitutes a blocking element for a lifting-spring element HBM1-2, which belongs to the first lifting module HBM1.

The lifting-spring element HBM1-2 is blocked in the stressed state by the tapered-ring segment AM1-4, since, in the non-triggered position I, the tapered-ring segment AM1-4 projects radially inward in relation to a head AM1-1 of the lifting-spring element HBM1-2 and thus blocks the lifting-spring element HBM1-2. The lifting-spring element HBM1-2 is supported, at its other end, on the lower cover of the first lifting module HBM1 (not illustrated).

The lifting rod V, which is connected to the liner G, is arranged on the head AM1-1 of the lifting-spring element HBM1-2. For triggering purposes, the flushing circuit is temporarily closed by a drop ball AM1-5. The drop ball AM1-5, which is dropped into the drill rods of the drill string 600 and is transported by the flushing stream, falls into the drop-ball seat AM1-3, the latter being connected to a sleeve-like piece of piping, and temporarily blocks the flushing stream. A pressure cushion AM1-6 builds up above the drop ball AM1-5 and pushes the sleeve-like piece of piping, including the drop ball AM1-5, downward.

The distance covered axially here by the sleeve-like piece of piping releases the form fit of the axial fixing of the tapered-ring segment AM1-4, the sleeve-like piece of piping displacing the blocking sleeve AM1-2 downward. The prestressed lifting spring HBM1-2 expands into a slightly prestressed position, carries along the lifting rod V axially upward in the process and raises the liner G into the pressure-chamber module DKM.

The triggered position II (FIG. 3A-2) has been reached and the liner G has covered the distance Δz2 (FIG. 1I) in a so-called sample-displacement action. The sample displacement Δz2 thus takes place by virtue of the stressed lifting-spring element HBM1-2 expanding. Without triggering by means of the first triggering module AM1, said lifting-spring element is prevented from expanding in a form-fitting manner by the tapered-ring segment AM1-4. If the axial fixing is disengaged by the first triggering module AM1, the lifting-spring element HBM1-2 expands and draws the lifting rod V upward.

The above described solution in this variant discloses a semi-automatic lifting module HBM1, since the first lifting module HBM1 interacts with the first triggering module AM1 as follows. In the case of a semi-automatic lifting module, the sample displacement Δz2 is triggered by a separate object interacting with the triggering module AM1. Use is made here, for example, of the above described drop ball AM1-5, generally an object of mass or some other separate auxiliary means for triggering the first lifting mechanism HBM1.

Figures 1, 3B:
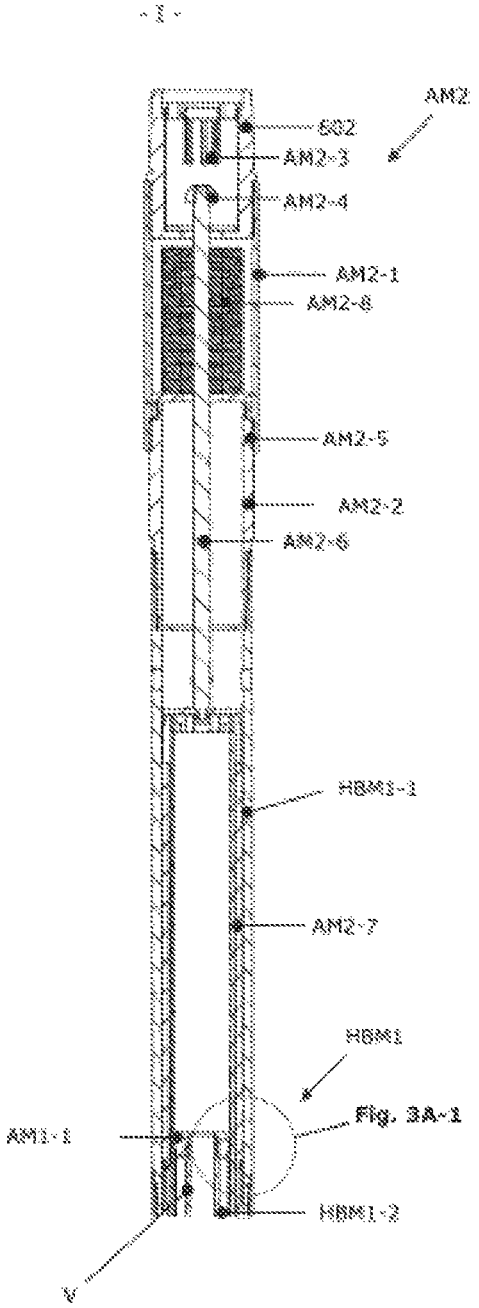
Figures 2, 3B:
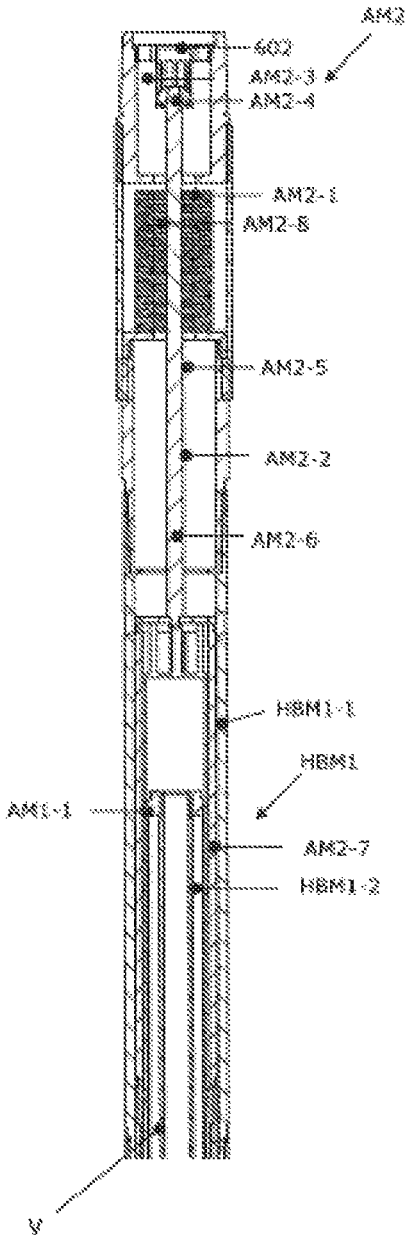

FIGS. 3B-1 and 3B-2 show the first lifting module HBM1 and a second triggering module AM2 in the non-triggered position I and the triggered position II, wherein the lifting module HBM1 constitutes the required energy store which, as a constituent part of the sampler 1, is activated by the second triggering module AM2, whereupon the pressure chamber of the pressure-chamber module DKM self-closes, once the first lifting module HBM1 has performed the necessary lifting movement prior to the pressure chamber being closed.

Second Triggering Module AM2:

First sub-step VS7.1 ("triggering of the sample displacement in order to raise the pressure-chamber module DKM") with the first lifting module HBM1 and the second triggering module AM2:

In this variant, the second triggering module AM2 is seated on the first lifting module HBM1. The second triggering module AM2 has a gripper AM2-3. This gripper AM2-3 is located axially opposite a gripper holder AM2-4. The gripper AM2-3 is arranged on the adapter piece 602 and the gripper holder AM2-4 is arranged on a triggering rod AM2-6. The adapter piece 602 is connected to those drill rods of the drill string 600 which are located above the adapter piece 602. The adapter piece 602 is also connected to a first housing part AM2-1 of the second triggering module AM2. A spring element AM2-8 in the manner of a disk-spring assembly is arranged in this first housing part AM2-1. The slightly prestressed disk-spring assembly AM2-8 is supported, on the one hand, on the underside of the adapter piece 602 and, on the other hand, on a second housing part AM2-2. The first housing part AM2-1 is connected to the second housing part AM2-2 via a spline-shaft connection AM2-5. The disk-spring assembly AM2-8 transmits the axial flow of forces, and the spline-shaft connection AM2-5 transmits the torque of the drill string 600, from the first housing part AM2-1 to the second housing part AM2-2, wherein the housing parts AM2-1 and AM2-2 can be moved relative to one another in the axial direction. The second housing part AM2-2 is connected to the lifting-module housing HBM1-1, whereas the first housing part AM2-1 is connected to the drill string 600.

Once the drilling operation has been completed (the process steps VS3, VS4, VS5 and VS6 have been completed), the preceding sub-step VS7.1 of the seventh process step VS7 involves, for the purpose of triggering the sample displacement Δz2, a brief increase in the weight of the drill string acting on the drill bit 610 of the drill string 600 (weight on bit) by way of a compressive force directed toward the sampler 1. This increase in compressive force is generated by a brief, controlled slackening of the drill string 600. On account of the inherent weight of the drill string 600, the slackening of the drill string 600 results in an axial, downwardly directed force on the sampler 1. This means that the axially movable, first housing part AM2-1 is pushed against the disk-spring assembly AM2-8.

The gripper AM2-3 here grips the gripper holder AM2-4 of the triggering rod AM2-6. The distance covered axially in relation to the second housing part AM2-2, and made possible via the spline-shaft connection AM2-5, results in the triggering rod AM2-6 shifting relative to the second housing part AM2-2 and thus relative to the lifting-module housing HBM1-1. As a result, a blocking sleeve AM2-7, which is arranged on an end-side headpiece of the triggering rod AM2-6, is raised.

A controlled raising operation of the drill string 600 reduces the pressure on the drill bit to which the drill bit 601 and the sampler 1 are subjected by the weight of the drill string, as a result of which the disk-spring assembly AM2-8 expands, and the first housing part AM2-1 is pushed upward again by the disk-spring assembly AM2-8. The blocking sleeve AM2-7 is carried along upward and frees the tapered-ring segment AM1-4 in the radial direction, and thus the head AM1-1 of the lifting-spring element HBM1-2, as a result of which the connecting element V, which is connected to the lifting-spring element HBM1-2, moves upward in the axial direction. The head AM1-1 of the lifting-spring element HBM1-2 is freed by this operation of raising the blocking sleeve AM2-7.

As a result, the form fit of the axial fixing of the prestressed lifting-spring element HBM1-2 of the first lifting module HBM1, said form fit being produced by the tapered-ring segment AM1-4, is released and the pressure core P is raised, in the seventh process step VS7, into the pressure-chamber module DKM by the sample displacement Δz2.

The first lifting module HBM1 is configured analogously in the region of the headpiece AM1-1 (see the circular detail in FIG. 3A-1 with a cross-reference to FIG. 3B-1 and vice versa).

In the non-triggered position I, the tapered-ring segment AM1-4 constitutes a blocking element for the lifting-spring element HBM1-2, which belongs to the first lifting module HBM1. As has been the case hitherto, the lifting-spring element HBM1-2 is blocked in the stressed state by the tapered-ring segment AM1-4, since, in the non-triggered position I, the tapered-ring segment AM1-4 projects radially inward in relation to a head AM1-1 of the lifting-spring element HBM1-2 and thus blocks the lifting-spring element HBM1-2. The lifting-spring element HBM1-2 is supported, at its other end, on the lower cover of the first lifting module HBM1 (not illustrated). The lifting rod V, which is connected to the liner G, is arranged on the head AM1-1 of the lifting-spring element HBM1-2.

In contrast to being triggered by means of the first triggering module AM1, in the case of which the blocking sleeve AM1-2 is displaced downward, the second triggering module AM2 moves the blocking sleeve AM2-7 upward.

Once the form fit has been disengaged, the stressed lifting-spring element HBM1-2 expands into a slightly prestressed position, carries along the lifting rod V axially upward in the process and raises the liner G into the pressure-chamber module DKM.

The triggered position II which is illustrated in FIG. 3B-2, shows, with reference to the lifting-spring element HBM1-2, that the liner G is raised into the pressure-chamber module DKM by the sample displacement Δz2. It is also basically the case that, in this second variant, the sample displacement Δz2 takes place by virtue of the stressed lifting-spring element HBM1-2 expanding.

The above described solution in this variant discloses a fully automatic lifting module HBM1, since the first lifting module HBM1 interacts with the second triggering module AM2 as follows. In the case of a fully automatic lifting module, the sample displacement Δz2 of the exemplary embodiment is triggered by the drill string 600 being compressed. There is no mass or other auxiliary means required for triggering purposes. There is no interaction with the second triggering module AM2 via a separate auxiliary means, as is the case with the semi-automatic lifting module HBM1, which interacts with the first triggering module AM1, according to FIGS. 3A-1, 3A-2 and the associated description.

Figures 1, 4A:
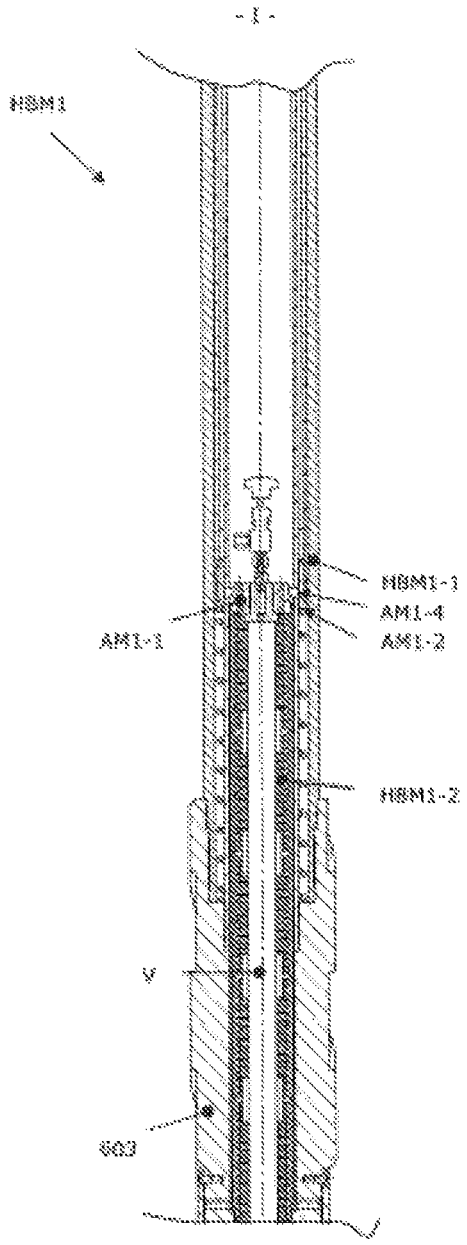
Figures 2, 4A:
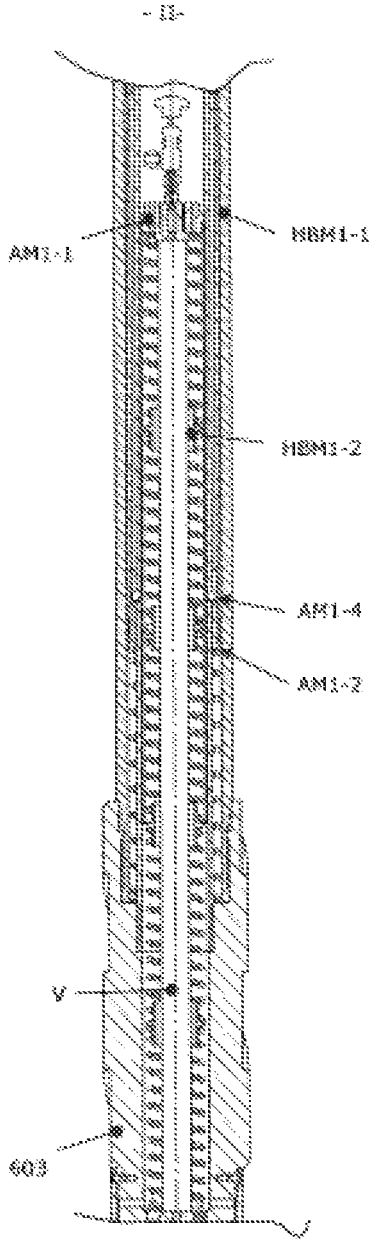

First Lifting Module HBM1:

Process step VS7 ("raising the pressure-chamber module DKM") with the first lifting module HBM1 and the first triggering module AM1:

FIGS. 4A-1 and 4A-2 show the first variant of the essentially already described first lifting module HBM1 of the sampler 1. FIG. 4A-1 illustrates the already described non-triggered position I and FIG. 4A-2 illustrates the triggered position II.

The lifting-module housing HBM1-1 is adjoined by a further adapter piece 603, which connects the first lifting module HBM1 to the pressure-chamber module DKM. It is possible to see the head AM1-1 of the lifting-spring element HBM1-2, said head being blocked with the aid of the first blocking element AM1-2, by the radially shifting tapered-ring segment AM1-4 of the first triggering module AM1, in the non-triggered position I. The triggered position II is illustrated in an analogous manner in FIG. 4A-2. The lower region of the first lifting module HBM1 has not been illustrated.

Figure 5A:
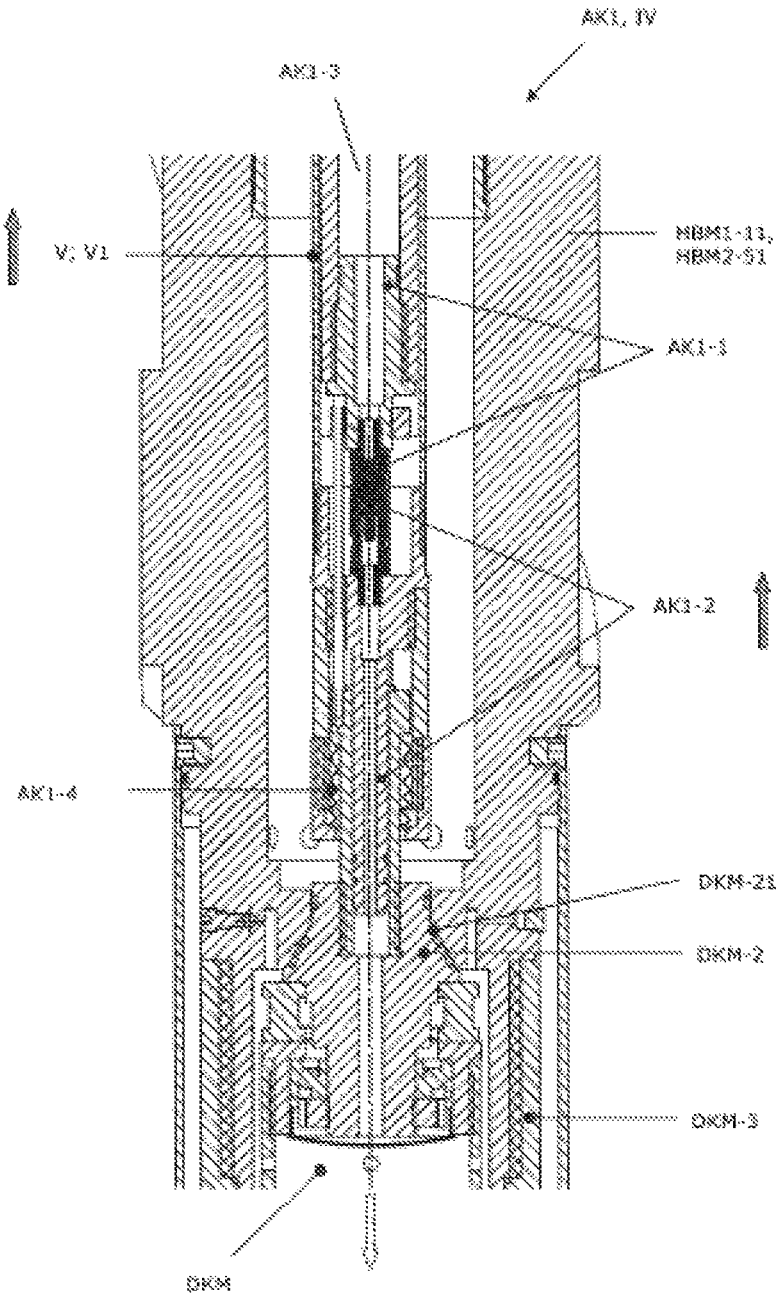
FIG. 5A shows a first variant of a pressure-regulating module (accumulator module) of the sampler.
Figures 1, 5B:
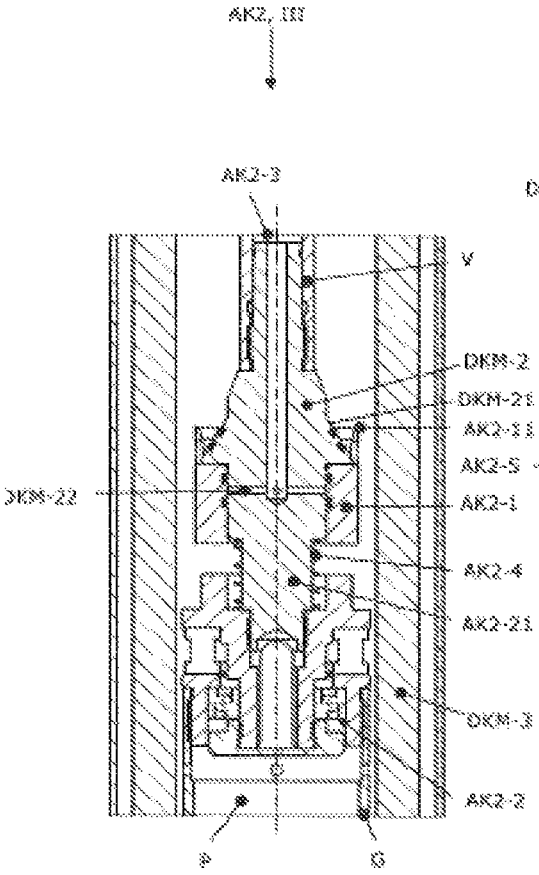
Figures 2, 5B:
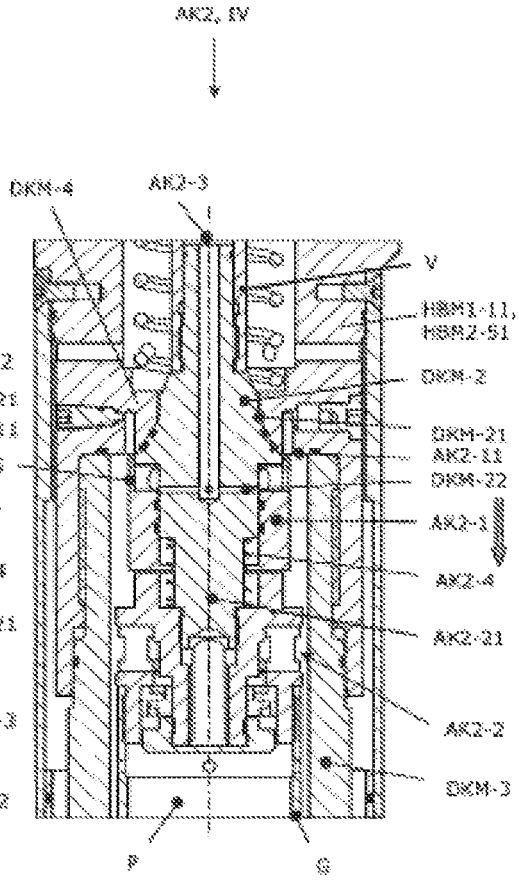

The lower region of the lifting rod V is shown in FIG. 5A (first variant of the pressure-regulating module AK1) and in FIG. 5B-1 and FIG. 5B-2 (second variant of the pressure-regulating module AK2).

Figure 4B:
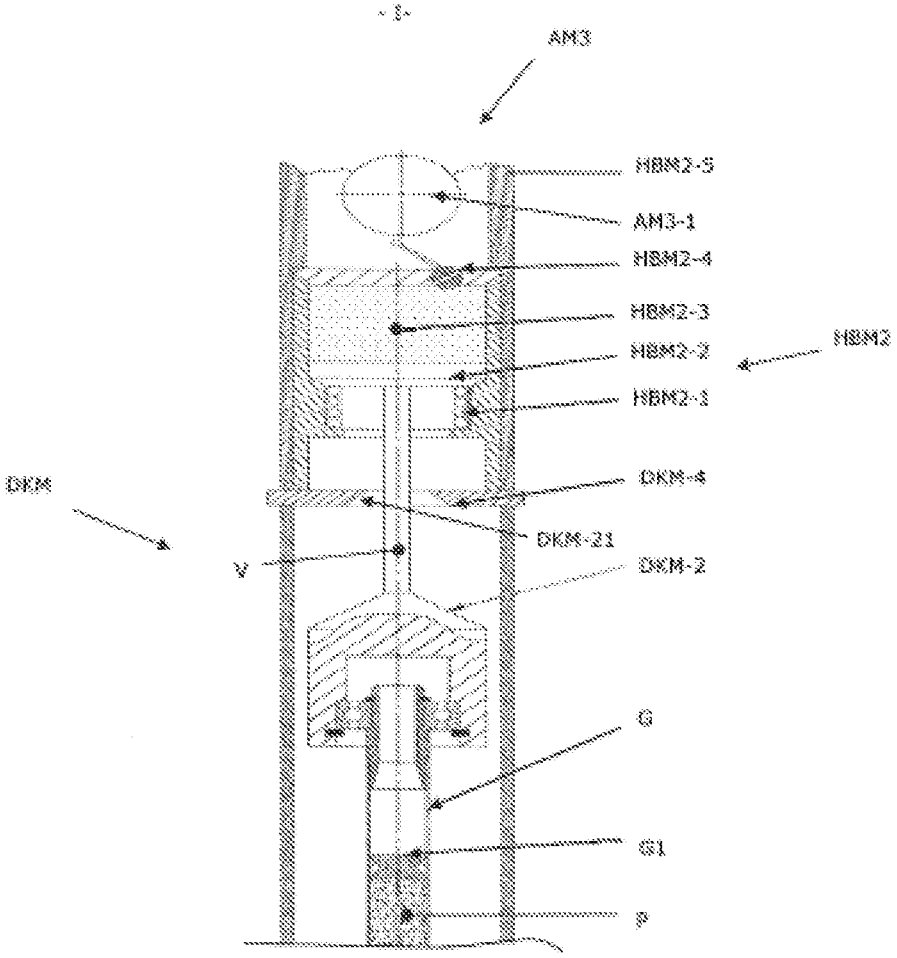
FIG. 4B shows a second variant of a lifting module of the sampler.

Second Lifting Module HBM2:

First sub-step VS7.1 and process step VS7 ("triggering the sample displacement in order to raise the liner G, and raising the liner G") with the second lifting module HBM2 and a third triggering module AM3:

FIG. 4B shows a second lifting module HBM2 of the sampler 1. This second lifting module HBM2 constitutes a second variant. The second lifting module HBM2 interacts with a novel opening and closing mechanism which is integrated in a flushing module SPM and is in the manner of a profile roller.

Figures 1, 2, 3, 6A:
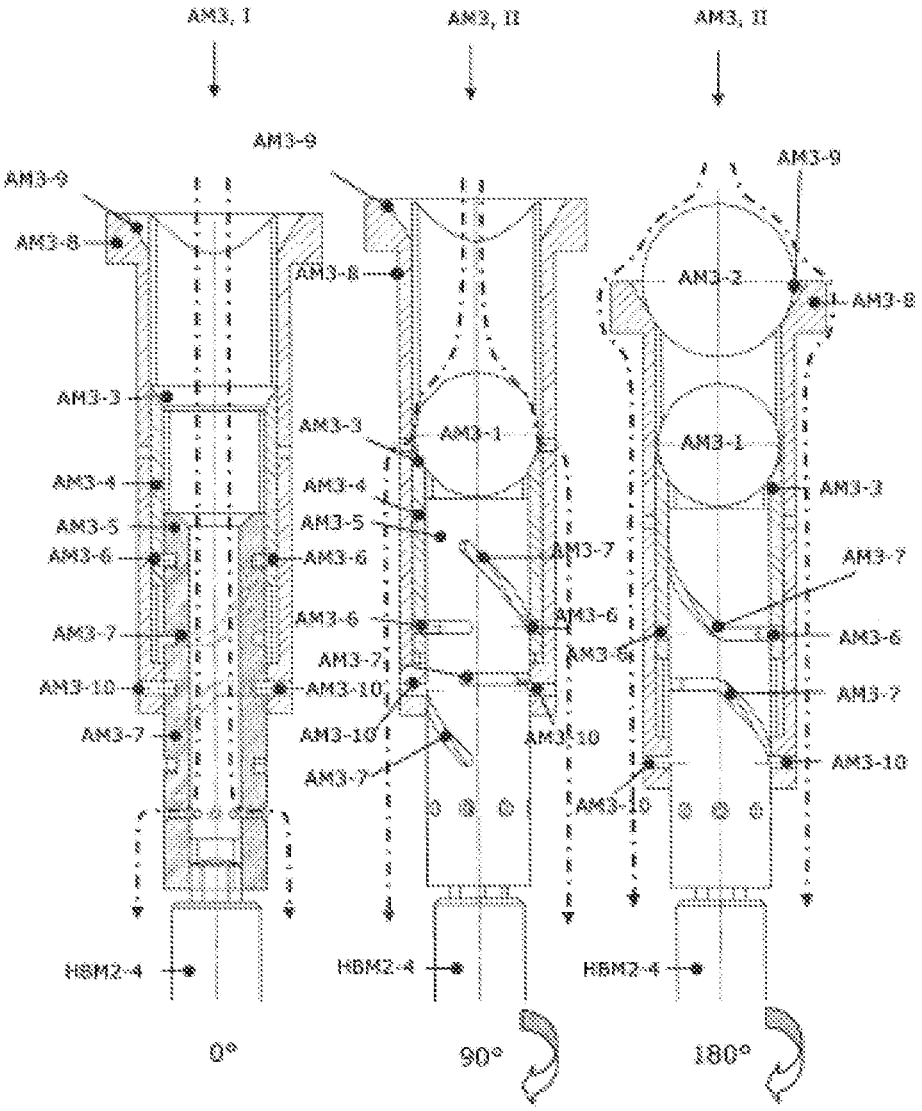

The profile roller has not been illustrated in FIG. 4B. The profile roller is illustrated in FIGS. 6A-1 to 6A-3. The components will be described using FIGS. 4B and 6A-1 to 6A-3 together.

The second lifting module HBM2 has a prestressed lifting-spring element HBM2-1 which, in a non-triggered position I, as illustrated in FIG. 4B, is prevented from expanding by a closed-off pressure cushion located above it in a pressure space HBM2-3 provided for this purpose. The pressure cushion is dissipated by virtue of a valve HBM2-4, which is illustrated schematically in FIG. 4B, being opened by means of a third triggering module AM3, as a result of which the prestressed lifting-spring element HBM2-1 expands and the lifting rod V is moved upward.

The valve HBM2-4 closes the pressure space HBM2-3 on one side, whereas, on the other side, a piston HBM2-2 assumes in relation to a sealing element, for example in relation to a tapered seat, its end position (triggered position II) in which it has been triggered in relation to its non-triggered starting position (non-triggered position I), and so ensures sealing of the pressure space HBM2-3. The movement of the lifting rod V, in the seventh process step VS7, raises the liner G into the pressure-chamber module DKM by the distance Δz2 (sample displacement). A second, upper sealing element DKM-2 is arranged above the liner G and, as second sealing element, alongside a first, lower sealing element DKM1 (not illustrated in FIG. 4B), ensures sealing of the pressure-chamber module DKM once displacement Δz2 has taken place.

The sealing elements DKM-1, DKM-2 will be discussed in more detail. The second, upper sealing element DKM-2 in FIG. 4B provides sealing in relation to a tapered seat DKM-21, which is formed on a pressure-chamber-module cover DKM-4, as soon as the sample displacement Δz2 has taken place. In order to effect the sample displacement Δz2, the third triggering module AM3 is moved into a triggered position II, which causes the valve HBM2-4 to open.

A freewheeling piston G1 is arranged within the liner G in FIG. 4B, and ensures that the pressure core P does not slip, or slip out, during the extracting operation.

The function of the third triggering module AM3 is illustrated in FIGS. 6A-1 to 6A-3.

FIG. 6A-1 shows the non-triggered position I. In FIG. 6A-1, the third triggering module AM3 is located in a starting position, in which the valve HBM2-4 (see FIG. 4B) has been closed.

The valve HBM2-4 is opened by a rotary movement generated at the lower end of the third triggering module AM3 by a profile roller AM3-5. The valve HBM2-4 is connected to the profile roller AM3-5, as depicted by the section shown in FIG. 6A-1. In order to effect the triggered position II or the triggered state, a first drop ball AM3-1 is dropped into those drill rods of the drill string 600 which are located above.

In the first, preceding sub-step VS7.1 of the seventh process step VS7, the drop ball AM3-1, which is transported by the flushing stream (chain-dotted line), falls into a drop-ball seat AM3-3 of a first, inner housing part AM3-4 or of a drop-ball seat AM3-9 of a second, outer housing part AM3-8, in particular of the polygonal profile pipes, and temporarily blocks the flushing stream.

A pressure cushion builds up above the first—relatively small—drop ball AM3-1 and pushes the first, inner housing part AM3-4, including the first drop ball AM3-1, downward. The distance covered axially by the first housing part AM3-4 in relation to a second, outer housing part AM3-8, for example likewise a polygonal profile pipe, is converted into a rotary movement, and transmitted, by the positive guidance of pins AM3-6, AM3-10 in the grooves AM3-7 of the profile roller AM3-5. The polygonal shape of the profile pipes is only by way of example. It is also possible to use other shapes. The polygonal configuration of the profile pipes, which has been described by way of example, ensures that the housing parts AM3-4 and AM3-8 cannot rotate relative to one another.

The outer, second housing part AM3-8, which is secured against rotary movements, also prevents rotation of the first housing part AM3-4. The pins AM3-6 are arranged in the first housing part AM3-4 and the pins AM3-10 are arranged on a second housing part AM3-8 and project into the two grooves AM3-7 of the profile roller AM3-5. The direction of rotation and the angle of rotation of the profile roller AM3-5 can be controlled via the contour of the grooves AM3-7.

In the exemplary embodiment according to FIG. 6A-2, the first, inner housing part AM3-4, including the first drop ball AM3-1 that comes into contact with the drop-ball seat AM3-3, is pushed downward to the extent where the profile roller AM3-5 rotates through, for example, 90°.

If a second—larger—drop ball AM3-2 is dropped onto the tapered seat AM3-9 of the second, outer housing part AM3-8, a further rotation in the same direction through a further 90° takes place in the exemplary embodiment. In the case of a different configuration of the contour of the groove AM3-7 belonging to the pins AM3-10, it is also possible to have an opposite direction of rotation. As mentioned, the angle of rotation can be defined by the contour of the grooves AM3-7.

The resulting rotary movement of the profile roller AM3-5 thus opens or closes the valve HBM2-4 and expands, for example, the pressure cushion in the second lifting module HBM2 (FIG. 4B).

The profile roller AM3-5, as part of the third triggering module AM3, thus moves in a number of stages. To summarize, individual routing of the grooves AM3-7 in the profile roller AM3-5 and the repeated dropping of drop balls AM3-1, AM3-2 of different sizes make it possible to control the angle of rotation over time and also to reverse the direction of rotation.

The component referred to as the profile roller AM3-5 is not restricted to the use described here. Irrespective of the use described, it is advantageously recommended as an opening and closing mechanism whenever a translatory movement is to be converted into a rotary movement (as in the present case), or vice versa, at an inaccessible location.

The two variants of different pressure-regulating modules AK1, AK2 (accumulator modules) will be discussed herein below.

First Pressure-Regulating Module AK1 (First Accumulator Module):

First sub-step VS8.1 and process step VS8 ("closing the pressure-chamber module DKM") with the first pressure-regulating module AK1:

Provision is made for the first pressure-regulating module AK1 to become operative essentially just after the pressure-chamber module DKM has been closed, this being carried out by the sample displacement Δz2 of the liner G.

FIG. 5A shows a first variant of the first pressure-regulating module AK1 of the sampler 1.

In the first variant, in a first sub-step VS8.1 following the closure of the pressure-chamber module DKM in the eighth process step VS8, a connection between the pressure-chamber module DKM and the first pressure-regulating module AK1 is established by a quick-action coupling ensuring that a fluid subjected to the action of a pressure cushion flows through freely into a space of the pressure-chamber module DKM which encloses the liner G.

A quick-action coupling AK1-1, AK1-2 of the first pressure-regulating module AK1 is arranged in the lifting rod V of the lifting module HBM1 or HBM2 (usable in both lifting-module variants). The respective lifting rod V has a lifting-rod wall V1.

In the first variant (FIGS. 4A-1 and 4A-2), the lifting-rod wall V1 is connected to the head AM1-1 of the lifting-spring element HBM1-2 of the first lifting module HBM1. In the second variant, the lifting-rod wall V1 is connected to the piston HBM2-2 of the lifting-spring element HBM2-1 of the second lifting module HBM2.

As becomes clear from the description of the two lifting modules HBM1, HBM2, the sample displacement Δz2 (process step VS7) results in an upward movement of the lifting rod V, and thus of the lifting-rod wall V1, in the direction of the arrow alongside reference sign V1.

A first, fixed, upper quick-action-coupling part AK1-1 is arranged in the lifting-rod wall V1 and moves along, accordingly, with the lifting rod V. A second, movable, lower quick-action-coupling part AK1-2 is arranged within the lifting-rod wall V1. The quick-action-coupling parts AK1-1, AK1-2 are (not illustrated) not coupled in the first instance.

FIG. 5A illustrates the coupled position IV. In the first instance, a spring element AK1-4, which is arranged in an installation space provided for this purpose, ensures that the second, movable, lower quick-action-coupling part AK1-2 is pushed away from the first, fixed, upper quick-action-coupling part AK1-1, via the lifting-rod wall V1. This is because the spring element AK1-4 is supported on the one hand—at the top—on a protrusion of the second, movable, lower quick-action-coupling part AK1-2 and on the other hand—at the bottom—on a horizontal part of the lifting-rod wall V1.

At the end of the sample displacement Δz2 achieved by the lifting rod V—in the upward direction—in the direction of the arrow alongside reference sign V1 of the lifting-rod wall V1, once the first, lower sealing element DKM-1 and the second, upper sealing element DKM-2 have already been closed, the spring element AK1-4 is subjected to a force via the horizontal part of the lifting-rod wall V1, as a result of which the spring element AK1-4 is then compressed and transmits the force to the second, movable, lower quick-action-coupling part AK1-2, which, according to FIG. 5A, executes a movement from bottom to top in the direction of the arrow alongside reference sign AK1-2, as a result of which the movable, lower quick-action-coupling part AK1-2 couples to the first, fixed, upper quick-action-coupling part AK1-1.

In the coupled position IV, according to FIG. 5A, the fluid flows (in the direction of the dotted arrow illustrated at the bottom) out of the hollow lifting rod V and the hollow quick-action-coupling parts, and through the hollow parts of the first pressure-regulating module AK1, into the pressure chamber of the pressure-chamber module DKM.

The lifting rod V is filled with liquid and a gas, which forms a pressure cushion above the liquid. The two media are charged to an appropriate positive pressure and are separated by a piston.

The quick-action-coupling parts AK1-1, AK1-2 are connected to one another by the two quick-action-coupling parts AK1-1, AK1-2 being moved axially relative to one another once the second, upper sealing element DKM-2 has been closed—with the cone being drawn into the tapered sealing seat DKM-21—see FIGS. 4B and 5A).

The point in time at which the coupling takes place can advantageously be adjusted by appropriate dimensioning of the movements of the quick-action-coupling parts AK1-1, AK1-2 relative to one another.

Immediate sealing of the pressure-chamber module DKM is ensured by the first pressure-regulating module AK1 by way of an initial preliminary pressing action of the sealing elements DKM-1, DKM-2, on the one hand, for example, of the tapered seat DKM-21 at the upper end and, on the other hand, of the lower sealing element DKM-1 at the lower end.

Second Pressure-Regulating Module AK2 (Second Accumulator Module):

First sub-step VS8.1 and process step VS8 ("closing the pressure-chamber module") with the second pressure-regulating module AK2:

FIGS. 5B-1 and 5B-2 show a second variant of a second pressure-regulating module AM2 (second accumulator module) of the sampler 1.

FIG. 5B-1, shows the pressure-regulating module AK2 in the uncoupled position III and FIG. 5B-2 shows the same in the coupled position IV.

In the second variant, once the pressure-chamber module DKM has been closed in the eighth process step VS8, coupling between the pressure-chamber module DKM and the second pressure-regulating module AK2 is established, in a first sub-step VS8.1, by previously sealed bores DKM-22 of the second, upper sealing element DKM-2 being freed, these bores ensuring that the fluid subjected to a pressure cushion flows through freely into a space of the pressure-chamber module DKM which encloses the liner G.

A displacement sleeve AK2-1 is provided in the second variant. The lifting rod V of the first or second lifting module HBM1, HBM2, said lifting rod being illustrated in FIGS. 5B-1 and 5B-2, is of hollow configuration, wherein a fluid and gas space AK2-3 (not illustrated in any more detail) is filled with a liquid and a gas, which forms a pressure cushion above the liquid.

It is also the case with the second pressure-regulating module AK2 that the two media are charged to an appropriate positive pressure and are separated by a piston. At least one freeable bore DKM-22 is located at the lower end of the lifting rod V, in the cone of the second, upper sealing element DKM-2, and this bore allows pressure equalization between the pressure-regulating module AK2 and the pressure-chamber module DKM.

In the uncoupled position III (FIG. 5B-1), the displacement sleeve AK2-1, which is arranged in a displaceable manner on a bearing core AK2-21, which may be of conical configuration, of a bearing AK2-2, closes the bores DKM-22 via radial sealing rings. The conical configuration of the bearing core results in a projection surface on which the prevailing differential pressure acts and which pushes the displacement sleeve AK2-21 in the direction of the cone of the upper sealing element. In addition, or as an alternative, to the cone, a spring element AK2-4 is supported, on the one hand, on the bearing AK2-2 and, on the other hand, on the displacement sleeve AK2-1. The displacement sleeve AK2-1 is located, in the first instance, in a non-triggered position. In the non-triggered position, the displacement sleeve AK2-1 is stopped against the cone of the second, upper sealing element DKM-2.

The sample displacement Δz2 takes place in the first instance (process step VS7). Just prior to the end of the sample displacement Δz2 of the lifting rod V, during the last section of the lifting-rod movement, at least one bore DKM-22 is freed in the first sub-step VS8.1 of the eighth process step VS8.

The displacement sleeve AK2-1 has an upper edge AK2-11. Just prior to the end of the sample displacement Δz2, this upper edge AK2-11 of the displacement sleeve AK2-1 comes into contact with the lower edge of the tapered seat DKM-21 of the pressure-chamber-module cover DKM-4, which can be seen for the first time in FIG. 5B-2, and is thus pushed axially downward in the direction of the arrow, as a result of which at least one bore DKM-22 opens. The displacement sleeve AK2-1 is displaced on the block AK2-21 of the bearing AK2-2, counter to the force of the prevailing differential pressure and/or of the spring element AK2-4, and forms a gap AK2-5, via which the fluid flows into the pressure-chamber module DKM.

In the coupled position IV (FIG. 5B-2), the at least one bore DKM-22 has been opened by the displacement of the displacement sleeve AK2-1 on the core AK2-21 of the bearing AK2-2. The at least one bore DKM-22 is no longer sealed by the radial sealing rings of the displacement sleeve AK2-1.

The liner G, with the sample P, is indicated beneath the displacement sleeve AK2-1 and the bearing AK2-2, and has already been raised into the housing DKM-3 of the pressure-chamber module DKM.

In Respect of Both Pressure-Regulating Modules AK1 and AK2:

In a manner analogous to the description of the first pressure-regulating module AK1, within the first sub-step VS8.1 of the eighth process step VS8, it is thus advantageously the case that, by virtue of the second pressure-regulating module AK2 becoming operative, immediate sealing of the pressure-chamber module DKM is ensured by way of an initial preliminary pressing action of the sealing elements DKM-1, DKM-2, on the one hand, for example, of the tapered seat DKM-21 at the upper end and, on the other hand, of the lower sealing element DKM-1 at the lower end.

Also advantageously ensured here is the compensation for pressure losses during the recovery operation.

It is also advantageously possible, once one of the pressure-regulating modules AK1, AK2 has become operative, to regulate the pressure to a pressure above the "in-situ" pressure prevailing in the sampling environment.

The pressure-regulating modules AK1, AK2 form a gas-storage reservoir in the already mentioned gas space. A floating piston separates a gas-side pressure cushion from a liquid which is to be forced in (fluid and gas space AK1-3, AK2-3).

Following start-up—the respective pressure-regulating module AK1, AK2 becoming operative—the gas-side pressure cushion forces liquid into the pressure-chamber module DKM via the floating piston. The respective pressure-regulating module AK1, AK2 is coupled to the pressure-chamber module DKM. By virtue of a liquid (of a fluid) being forced in by way of the floating piston, pressure losses as a result of settling, or initial leakage at the seals DKM-1, DKM-2 as a result of volume compensation, are avoided, or at least minimized to the greatest extent.

The gas-storage reservoirs of prior-art pressure-regulating-module systems are compressed, on account of the increasing pressure at depth, as a sampler is let down and thus "charged", that is to say the conventional samplers are changed on the pressure side as they are let down, until they reach the sampling environment, to the extent where the pressure maintained in the pressure-regulating module of the sampler is always smaller than the hydrostatic pressure in the envisaged sampling environment.

It is advantageously the case that the pressure-regulating modules AK1, AK2 used for the sampler 1 according to the invention are charged, prior to the sampler 1 being used at depth, with a pressure which is higher than that prevailing at the envisaged sample depth. Even a pressure in the pressure-regulating module AK1, AK2 which is slightly higher than the pressure prevailing at the respective depth of the sampling environment is sufficient here.

The two initially separated regions, the pressure cushion in the fluid and gas space AK1-3, AK2-3 of the respective pressure-regulating module AK1, AK2 and the pressure-chamber module DKM, are coupled in the subsequent, first sub-step VS8.1 of the eighth process step VS8, wherein the pressure prevailing in the respective pressure-regulating module AK1, AK2 is higher, in the first instance, than in the pressure-chamber module DKM, but initially equalizes following the coupling operation and beyond this, during the operation of recovering the sample P, is maintained in dependence on the external pressure conditions, wherein the pressure-regulating module AK1, AK2 is charged to a specific higher pressure, for example, so as to maintain in the pressure-chamber module DKM the "in-situ" pressure prevailing at the sampling location.

If it is desired to have a pressure in the pressure-chamber module DKM at the investigation location which is higher than the "in-situ" pressure prevailing at the sampling location, the pressure-regulating module AK1, AK2 is charged, with the same boundary conditions being observed, to an even higher pressure than described before.

First and Second Sealing Elements DKM-1, DKM2:

Eighth process step VS8 ("closing the pressure-chamber module DKM") with the aid of the sealing elements DKM-1, DKM2 for sealing the pressure-chamber module DKM:

The operation of sealing the pressure-chamber module DKM with its housing DKM-3 takes place, as already described in process step VS8, by way of the second, upper sealing element DKM-2 at the upper end of the pressure chamber module DKM and by way of the first, lower sealing element DKM-1 at the lower end of the pressure-chamber module DKM, once the liner G has been raised through the opening of the pressure-chamber module DKM by means of the lifting rod V.

The second, upper sealing element DKM-2, which, as a cone, uses its conical lateral surface to seal against a tapered seat DKM-21 of the pressure-chamber module cover DKM-4 (FIG. 4B), has already been explained.

Figures 1, 2, 7A:
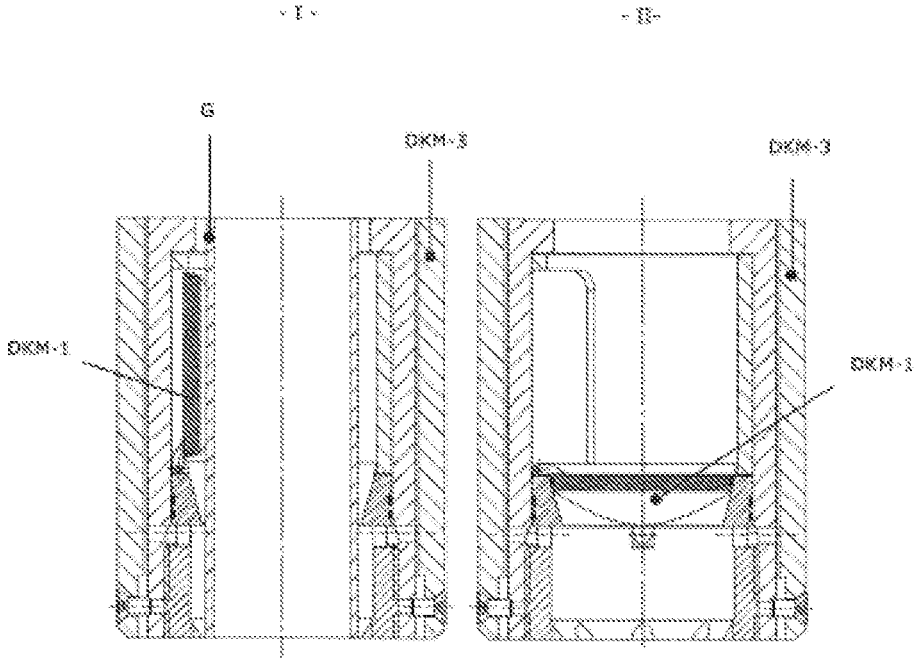

The first, lower sealing element DKM-1 is, for example, a pivotable sealing flap DKM-1, which is still open in FIG. 7A-1, prior to a triggering module AM1 or AM2 or AM3 being triggered, in the non-triggered position I. The liner G holds the first, lower sealing element DKM-1 open, since it has been positioned in the region of the first, lower sealing element DKM-1.

In FIG. 7A-2, the sealing flap DKM-1 has been closed following triggering by one of the triggering modules AM1 or AM2 or AM3, and once sample displacement Δz2 into the pressure-chamber module DKM, of which the housing DKM-3 is visible, has taken place by means of the lifting rod V, by way of one of the lifting modules HBM1 or HBM2, since the liner G no longer holds the first, lower sealing element DKM-1 open, since the liner G has left the region of the first, lower sealing element DKM-1 as a result of the sample displacement Δz2.

The following configuration of a sealing flap, in particular of the sealing flap DKM-1, is preferably provided. In the lower sealing region, the contact pressure of the flap seal in the flap seat, this pressure being necessary for sealing the pressure-chamber module DKM, is realized with the aid of, for example, magnets (not illustrated). The lower end of the pressure-chamber module DKM is sealed as a result of the sealing flap DKM-1 falling into the flap seat. This action takes place in a defined manner, by way of guides, and is initiated automatically in the interior of the sampler 1, rather than remote from outside, for example at the start by a prestressed leaf spring.

Remote initiation and the operation of pressing the sealing flap DKM-1 against its sealing seat can take place from outside by means of rubber straps, cable pulls or the like.

In order to achieve a high initial sealing level, the sealing flap DKM-1 is pressed into its sealing seat not just under its own weight, but also by the magnets (not illustrated) or, for example, by rubber straps, cable pulls or spring elements.

As already mentioned, it is advantageous for an initial preliminary pressing action of the sealing flap DKM-1 at the lower end to be brought about when one of the pressure-regulating modules AK1 or AK2 becomes operative during the operation of closing the sealing flap DKM-1, this ensuring quicker and more reliable sealing of the pressure-chamber module DKM.

A further special feature consists in provision being made for the pressure-regulating modules AK1, AK2 to be coupled to the pressure-chamber module DKM at as late a stage as possible.

In the case of the first pressure-regulating module AK1, the coupling takes place, in a first coupling mode, once the pressure-chamber module DKM has been fully closed at the upper and lower ends with the aid of respective sealing elements DKM-1, DKM-2.

In the case of the second pressure-regulating module AK2, the coupling takes place, in a second coupling mode, just prior to the second, upper sealing element DKM-2 being closed, once the first, lower sealing element DKM-1 has already been fully closed.

In the case of both coupling modes, quicker and more reliable sealing of the pressure-chamber module DKM is advantageously achieved by a pressure shock generated by the respective pressure-regulating module AK1, AK2 during the coupling operation, wherein the first coupling mode, in relation to the second coupling mode, allows even better initial sealing of the pressure-chamber module DKM, as a result of a pressure shock generated by the first pressure-regulating module AK1, since the upper, second sealing element DKM-2 and the lower, first sealing element DKM-1 of the pressure-chamber module DKM have already been fully closed at the time of the coupling operation and of the pressure shock.

Figure 8:
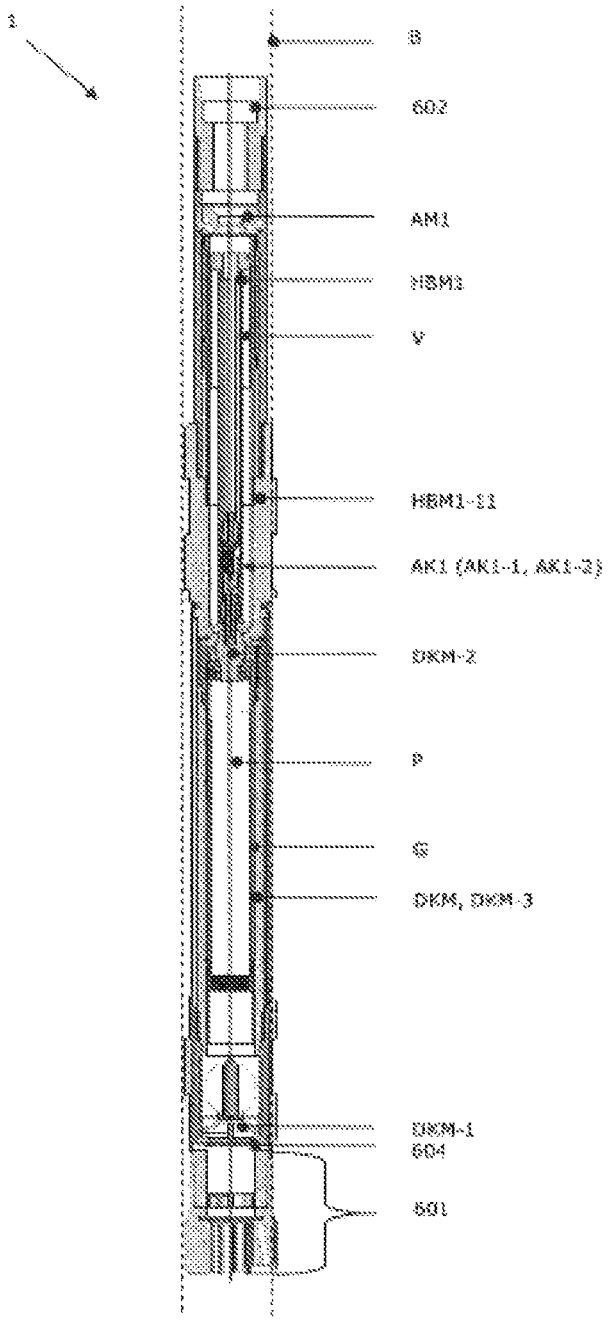
FIG. 8 shows an illustration of one variant of the sampler in an assembled state.

FIG. 8 shows an illustration of the autoclave sampler 1 in an assembled state. The modules which are used here by way of example may be replaced by other modules described in the variants. The modules can be used, according to the invention, in various combinations.

According to the illustration in FIG. 8, the autoclave sampler 1, which, as a result of the various possible combinations, is referred to, together with the drill string 600, as a drill-string configuration, comprises, for example, the adapter piece 602, for connecting the sampler 1 to the drill rods of the drill string 600, and the adapter piece 604, for connecting the sampler to the drill bit 601.

Seated beneath the adapter piece 602, according to FIGS. 3A-1 and 3A-2, is the first triggering module AM1, which has been combined with the first lifting module HBM1 according to FIGS. 3A-1 and 3A-2 and FIGS. 4A-1 and 4A-2. FIG. 5A shows the first pressure-regulating module AK1, designed as a quick-action coupling AK1-1, AK1-2, arranged in the lifting rod V, in a stabilizer part HBM1-11 of the first lifting module HBM1.

The housing DKM-3 of the pressure-chamber module DKM is closed at the top by a second, upper sealing element DKM-2, which is shown, for example, in FIG. 5A.

The housing DKM-3 of the pressure-chamber module DKM is closed at the bottom by a first, lower sealing element DKM-1, which is shown in FIGS. 7A-1 and 7A-2.

According to FIG. 8, the pressure-chamber module DKM contains the liner G, recovered "in situ", with the pressure core P located in the interior of the liner G. The liner G is located in the pressure-chamber module DKM, which is subjected to pressure by the first or second pressure-regulating module AK1, AK2—in the illustration of FIG. 8 by the first pressure-regulating module AK1. The changes in pressure which occur during the operation of recovering the pressure-chamber module DKM are compensated for by the pressure-regulating module AK1, and therefore, at the point in time when the pressure core P is investigated, the pressure which is present in the liner G is still the pressure which prevails originally at the sampling site or another desired pressure which is greater than the original pressure at the sampling site.

The invention claimed is:

1. An autoclave sampler for extracting a sample at a sampling site of a geological formation and comprising:

a self-closing pressure-chamber module for accommodating the sample, wherein the pressure-chamber module is connected to a lifting module in order to raise the sample in a sample-displacement action into the pressure-chamber module, and a triggering module and a pressure-regulating module arranged in a lifting rod, wherein the lifting rod is arranged between the lifting module and the sample, the sample is arranged in a liner, and the liner is connected with the lifting rod, wherein the triggering module acts on the lifting module arranged in a non-triggered position in order to trigger the lifting module, wherein:

the sample, following the sample displacement by the lifting module is raised and arranged in a pressure-tight manner in a housing within a closing pressure chamber of the pressure-chamber module as soon as the lifting module is freed by the triggering module, as a result of which the lifting module assumes its triggered position, and the pressure-regulating module which following the sample displacement, is coupled to the pressure-chamber module, at least on a pressure side, in order to influence the pressure in the pressure-chamber module.

2. The autoclave sampler as claimed in claim 1, wherein a first pressure-regulating module comprises a quick-coupling mechanism which, in its coupled position, frees a fluid and gas space arranged in a lifting rod of a lifting module.

3. The autoclave sampler as claimed in claim 1, wherein a second pressure-regulating module comprises a displacement sleeve which is seated on a bearing and, in its coupled position, frees a fluid and gas space arranged in the lifting rod of a lifting module.

4. The autoclave sampler as claimed in claim 1, wherein the first triggering module has a drop-ball seat which is connected directly or indirectly to a blocking element of a lifting-spring element of a lifting module, wherein triggering takes place by way of an object of mass, in particular by way of a drop ball, which temporarily blocks a flushing stream in the sampler, as a result of which the blocking element is moved radially and a lifting rod of the lifting module is freed and shifted by the sample displacement, as a result of which the lifting module assumes its triggered position.

5. The autoclave sampler as claimed in claim 1, further comprising a second triggering module comprising a first and a second housing part, which are connected to one another in an axially movable manner via a spline-shaft connection, wherein an axial flow of forces from the first housing part to the second housing part is transmitted by a disk-spring assembly, wherein the first housing part is connected to a drill string and the second housing part is connected directly or indirectly to a blocking element of a lifting-spring element of a lifting module, wherein triggering takes place by way of the drill string being compressed axially, as a result of which the blocking element is moved radially and a lifting rod of the lifting module is freed and shifted by the sample displacement, as a result of which the lifting module assumes its triggered position.

6. The autoclave sampler as claimed in claim 1, further comprising a third triggering module comprising a roller which activates a valve which closes a pressure space of a lifting module wherein the third triggering module has a drop-ball seat which belongs to a first housing part which is connected in relation to a second housing part with positive guidance, in particular via grooves and pins, such that a translatory movement of a first housing part results in a rotary movement of the roller, and of the valve connected to the roller, and vice versa, wherein triggering takes place by way of at least one object of mass, in particular by way of at least one drop ball on the drop-ball seat, said drop ball temporarily blocking a flushing stream in the third triggering module, as a result of which the valve opens the pressure space, and a lifting-spring element of a lifting module moves a piston, which is connected to the pressure space, axially in a direction of the expanding pressure space, as a result of which a lifting rod of the lifting module is freed and shifted by the sample displacement, as a result of which the lifting module assumes its triggered position.

7. The autoclave sampler as claimed in claim 1, further comprising a second lifting module, wherein a first and second lifting module each have a lifting-spring element which, in a non-triggered position, is located in a stressed state and, in the triggered position, is located in a prestressed state and of which the spring force stored in the stressed state, following triggering by way of one of the triggering modules, forces the sample displacement, wherein the lifting-spring element is operatively connected to the lifting rod, which, for its part, is connected to the pressure-chamber module.

8. The autoclave sampler as claimed in claim 1, wherein the pressure-chamber module comprises a first flap sealing element and a second flap sealing element, which are arranged essentially on the end side of the pressure-chamber module.

9. A process for extracting a sample at a sampling site in a geological formation by means of a drilling installation comprising a drill string and an end-side drill bit, in which, in a first trip first, a drill hole having a drill-hole floor is drilled, secondly, the drill string with the drill bit is removed from the drill hole again, wherein in a second trip thirdly, a sampler is mounted between the drill string and drill bit, fourthly, the drill string and the sampler and the drill bit are introduced into the drill hole, fifthly, in the drill hole, the sample is drilled from the drill-hole floor of the previously drilled drill hole, sixthly, a detachment displacement is carried out, during which the sample is separated from the geological formation, and then, seventhly, the sample displacement is triggered by a triggering module, so that a housing, with the sample, is raised into a pressure chamber of a pressure-chamber module of the sampler by means of a lifting module and positioned between a first and a second sealing element of the pressure-chamber module, eighthly, the sample in the housing is closed in a pressure-tight manner by virtue of the two sealing elements of the pressure chamber of the sampler being closed, wherein the pressure chamber can be influenced on the pressure side by a pressure-regulating module during or following the closing operation, ninthly, the drill string and the sampler with the drill bit are removed from the drill hole, tenthly, the sampler, with the sample located in the housing in the pressure-tight pressure chamber of the pressure-chamber module, is separated from the drill string and the drill bit.

10. The process as claimed in claim 9, wherein the sampling-site pressure in the pressure chamber of the pressure-chamber module of the sampler, following closure of the two sealing elements of the sampler, is influenced on the pressure side during the recovery operation and beyond by the pressure-regulating module, which is integrated in the sampler, in a subsequent first sub-step of the eighth process step, wherein the pressure-regulating module is charged to a positive pressure which is greater than the pressure prevailing in the sampling environment, as a result of which there is an adjustment in the pressure of the sample in the pressure chamber of the pressure-chamber module, and therefore the pressure at the investigation site coincides with the pressure prevailing at the sampling site or is greater than at the sampling site.

11. The process as claimed in claim 10, wherein the pressure regulation in the subsequent first sub-step of the eighth process step is effected by a connection, which is located in a coupled position, between the lifting module and the pressure-regulating module having a fluid and gas space.

12. The process as claimed in claim 11, wherein the pressure regulation in the subsequent first sub-step of the eighth process step is controlled, via the sample displacement of the lifting module, by the connection, which is located in the coupled position, between the lifting module and the pressure-regulating module having the fluid and gas space.

13. The process as claimed in claim 12, wherein the sample displacement of the lifting module is controlled by the triggering module in a preceding first sub-step of the seventh process step.

14. The process as claimed in claim 11, wherein the coupling of the first or second pressure-regulating module to the pressure-chamber module in the subsequent first sub-step of the eighth process step brings about an initial preliminary pressing action of the sealing elements.

15. The process as claimed in claim 9, wherein the sample displacement of the lifting module is controlled by a first and third triggering module activated by a drop ball, in the preceding first sub-step of the seventh process step.

16. The process as claimed in claim 9, wherein a second triggering module is activated by virtue of the drill string being compressed in the first preceding sub-step of the seventh process step.

17. The process as claimed in claim 9, further comprising coupling the first pressure-regulating module to the pressure-chamber module in the first subsequent sub-step of the eighth process step, in a first coupling mode, once the pressure-chamber module has been fully closed at the upper and lower ends with the aid of the respective sealing elements.

18. The process as claimed in claim 9, further comprising coupling the second pressure-regulating module to the pressure-chamber module in the subsequent first sub-step of the eighth process step in a second coupling mode—just prior to the second, upper sealing element being closed, once the first, lower sealing element has already been fully closed.

* * * * *